US008617033B2

(12) United States Patent
Stewart

(10) Patent No.: US 8,617,033 B2
(45) Date of Patent: Dec. 31, 2013

(54) EXERCISE APPARATUSES AND METHODS OF USING THE SAME

(76) Inventor: Jeffrey David Stewart, Sammamish, WA (US)

( * ) Notice: Subject to any disclaimer, the term of this patent is extended or adjusted under 35 U.S.C. 154(b) by 450 days.

(21) Appl. No.: 12/865,695

(22) PCT Filed: Jan. 30, 2009

(86) PCT No.: PCT/US2009/032748

§ 371 (c)(1),
(2), (4) Date: Nov. 29, 2010

(87) PCT Pub. No.: WO2009/097589

PCT Pub. Date: Aug. 6, 2009

(65) Prior Publication Data

US 2011/0092339 A1 Apr. 21, 2011

Related U.S. Application Data

(60) Provisional application No. 61/063,256, filed on Jan. 31, 2008.

(51) Int. Cl.
*A63B 25/10* (2006.01)
*A43B 3/10* (2006.01)

(52) U.S. Cl.
USPC ..... 482/77; 482/51; 36/7.8

(58) Field of Classification Search
USPC ..... 482/14, 51–54, 74–77, 79, 80, 148; 36/7.8, 81, 117.5, 132, 140
See application file for complete search history.

(56) References Cited

U.S. PATENT DOCUMENTS

| | | | | |
|---|---|---|---|---|
| 1,516,395 | A * | 11/1924 | Miceli | 36/7.8 |
| 1,613,538 | A | 1/1927 | Schad | |
| 1,843,493 | A * | 2/1932 | Pfeifenbring | 36/7.8 |
| 2,172,000 | A | 9/1939 | Wenker | 272/70 |
| 2,242,748 | A * | 5/1941 | Fulwiler | 482/75 |
| 2,345,085 | A * | 3/1944 | Albert et al. | 267/151 |
| 2,404,083 | A * | 7/1946 | Murray | 36/140 |
| 2,644,248 | A * | 7/1953 | Seligman | 36/7.5 |
| 2,837,840 | A | 6/1958 | Kerpel | 36/7.8 |
| 3,377,722 | A | 4/1968 | Downing | 36/7.8 |
| 3,641,601 | A * | 2/1972 | Sieg | 5/420 |
| 4,133,086 | A | 1/1979 | Brennan | 36/7.8 |
| 4,196,903 | A | 4/1980 | Illustrato | 272/114 |

(Continued)

FOREIGN PATENT DOCUMENTS

| | | |
|---|---|---|
| DE | 2064414 | 7/1972 |
| EP | 0103041 A1 | 3/1984 |

(Continued)

OTHER PUBLICATIONS

International Search Report and Written Opinion, mailed on Apr. 27, 2009 for PCT/US2009/032748, 14 pages.

*Primary Examiner* — Stephen Crow
(74) *Attorney, Agent, or Firm* — Perkins Coie LLP

(57) ABSTRACT

An exercise apparatus includes a pair of step-up apparatuses wearable on feet of a user. Each step-up apparatus is configurable between an expanded configuration and a compressed configuration to simulate a selected motion when the user wearing the pair of step-up apparatuses travels by foot. One of the step-up apparatuses moves towards the expanded configuration while the other step-up apparatus moves towards the compressed configuration.

29 Claims, 37 Drawing Sheets

(56) References Cited

U.S. PATENT DOCUMENTS

| | | | | | |
|---|---|---|---|---|---|
| 4,271,606 | A | | 6/1981 | Rudy | 36/29 |
| 4,305,212 | A | | 12/1981 | Coomer | 36/80 |
| 4,319,412 | A | | 3/1982 | Muller et al. | 36/29 |
| 4,451,994 | A | | 6/1984 | Fowler | 36/28 |
| 4,492,374 | A | | 1/1985 | Lekhtman et al. | 272/114 |
| 4,534,124 | A | | 8/1985 | Schnell | 36/114 |
| 4,547,978 | A | | 10/1985 | Radford | 36/3 B |
| 4,619,059 | A | * | 10/1986 | Koniuk | 36/132 |
| 4,697,361 | A | | 10/1987 | Ganter et al. | 36/28 |
| 4,754,559 | A | | 7/1988 | Cohen | 36/3 B |
| 4,864,737 | A | | 9/1989 | Marrello | 36/29 |
| 4,912,859 | A | * | 4/1990 | Ritts | 36/7.8 |
| 4,936,030 | A | | 6/1990 | Rennex | 36/28 |
| 5,138,776 | A | | 8/1992 | Levin | 36/38 |
| 5,205,798 | A | | 4/1993 | Lekhtman | 482/77 |
| 5,224,810 | A | | 7/1993 | Pitkin | 36/30 R |
| 5,337,492 | A | | 8/1994 | Anderiéet al. | 36/28 |
| 5,464,380 | A | * | 11/1995 | Ikeda et al. | 601/29 |
| 5,643,148 | A | | 7/1997 | Naville | 482/77 |
| 5,647,147 | A | | 7/1997 | Coomer | 36/93 |
| 5,675,915 | A | * | 10/1997 | Faughn et al. | 36/7.5 |
| 5,685,092 | A | | 11/1997 | Prieskorn | 36/93 |
| 5,794,359 | A | | 8/1998 | Jenkins et al. | 36/28 |
| 5,902,214 | A | | 5/1999 | Makikawa et al. | 482/4 |
| 5,916,071 | A | | 6/1999 | Lee | 482/77 |
| 5,918,502 | A | * | 7/1999 | Bishop | 73/172 |
| 6,115,943 | A | | 9/2000 | Gyr | 36/35 R |
| 6,266,897 | B1 | | 7/2001 | Seydel et al. | 36/29 |
| 6,266,898 | B1 | | 7/2001 | Cheng | 36/29 |
| 6,312,361 | B1 | * | 11/2001 | Hayes | 482/51 |
| 6,349,487 | B1 | | 2/2002 | Hice | 36/140 |
| 6,405,455 | B1 | | 6/2002 | Walsh | 36/28 |
| 6,436,012 | B1 | | 8/2002 | Naville | 482/77 |
| 6,457,262 | B1 | | 10/2002 | Swigart | 36/29 |
| 6,516,540 | B2 | | 2/2003 | Seydel et al. | 36/29 |
| 6,722,059 | B2 | | 4/2004 | Robinson, Jr. et al. | 36/29 |
| 6,754,981 | B1 | | 6/2004 | Edwards | 36/29 |
| 6,782,639 | B1 | | 8/2004 | Müller | 36/28 |
| 6,823,612 | B2 | | 11/2004 | Manz et al. | 36/103 |
| 6,845,573 | B2 | | 1/2005 | Litchfield et al. | 36/29 |
| 6,915,594 | B2 | | 7/2005 | Kim | 36/29 |
| 6,962,008 | B2 | | 11/2005 | Manz et al. | 36/25 R |
| 6,979,287 | B2 | * | 12/2005 | Elbaz et al. | 482/148 |
| 6,983,555 | B2 | | 1/2006 | Lacorazza et al. | 36/30 R |
| 6,983,557 | B2 | | 1/2006 | Manz et al. | 36/103 |
| 7,007,412 | B2 | * | 3/2006 | Munster | 36/132 |
| 7,140,124 | B2 | | 11/2006 | Manz et al. | 36/25 R |
| 7,181,867 | B2 | | 2/2007 | Litchfield et al. | 36/29 |
| 7,188,439 | B2 | * | 3/2007 | DiBenedetto et al. | 36/132 |
| 7,254,905 | B2 | | 8/2007 | Dennison | 36/15 |
| 7,290,354 | B2 | * | 11/2007 | Perenich | 36/27 |
| 7,377,057 | B2 | | 5/2008 | Lacorazza et al. | 36/35 R |
| 7,383,648 | B1 | | 6/2008 | Litchfield et al. | 36/29 |
| 7,788,823 | B2 | * | 9/2010 | Killion et al. | 36/7.8 |
| 2002/0083616 | A1 | | 7/2002 | Hajianpour | 36/7.8 |
| 2005/0086838 | A1 | | 4/2005 | Khantzis | 36/30 R |
| 2005/0132617 | A1 | | 6/2005 | Potter et al. | 36/132 |
| 2007/0006489 | A1 | * | 1/2007 | Case et al. | 36/132 |
| 2007/0074430 | A1 | | 4/2007 | Coomer | 36/145 |
| 2008/0209764 | A1 | | 9/2008 | Fusco | 36/91 |
| 2008/0276494 | A1 | | 11/2008 | Lacorazza et al. | 36/88 |
| 2008/0317487 | A1 | | 12/2008 | Murakami | 399/45 |
| 2009/0100719 | A1 | * | 4/2009 | Pierre | 36/132 |
| 2009/0137933 | A1 | | 5/2009 | Lieberman et al. | 600/595 |
| 2009/0260426 | A1 | | 10/2009 | Lieberman et al. | 73/65.01 |
| 2010/0063778 | A1 | | 3/2010 | Schrock et al. | 702/188 |
| 2010/0063779 | A1 | | 3/2010 | Schrock et al. | 702/188 |

FOREIGN PATENT DOCUMENTS

| | | | |
|---|---|---|---|
| FR | 2594344 | A1 * | 8/1987 |
| JP | 200620656 | | 1/2006 |
| WO | 2005011419 | A2 | 2/2005 |

* cited by examiner

EXERCISE APPARATUSES AND METHODS OF USING THE SAME

CROSS-REFERENCE TO RELATED APPLICATION

This application claims the benefit under 35 U.S.C. §119(e) of U.S. Provisional Patent Application No. 61/063,256 filed Jan. 31, 2008, which is incorporated herein by reference in its entirety.

BACKGROUND

1. Technical Field

The present disclosure generally relates to exercise apparatuses, and more specifically, to cardiovascular exercise apparatuses.

2. Description of the Related Art

Exercise equipment for cardiovascular exercise is often used in gymnasiums or homes. It may be difficult or impossible to use stationary exercise equipment while performing other activities. For example, an individual using a treadmill or an elliptical machine may be unable to perform activities that require mobility, such as many household chores. This inconvenience may deter people with busy schedules from exercising. People also may not exercise because of the travel time to and from sport facilities, hiking trails, gymnasiums, or other workout facilities suitable for performing strenuous cardiovascular exercises that can strengthen and build muscles.

Activities (e.g., running, jogging, and walking) can be performed without utilizing stationary exercise equipment. Running and other high impact activities may be unsuitable for people with arthritis, damaged bones (e.g., bones with stress fractures), damaged joints, or damaged connective tissue. Running may also lead to injuries, tissue damage, and pain/discomfort. For example, chrondromalacia patella (commonly referred to as runner's knee) is a condition that may be caused by running. To minimize trauma to joints or connective tissue, people often perform low impact activities; however, low impact activities, such as walking, often do not provide a desired level of aerobic activity and may be ineffective at strengthening or building muscles.

BRIEF SUMMARY

Exercise apparatuses disclosed herein can be used while performing various activities, such as walking, running, hiking, workout routines, or other normal everyday activities. The exercise apparatuses can be worn on an individual's feet in order to provide a desired exercise program. The exercise program can be designed to simulate various types of motions, strengthen muscles, tone muscles, increase aerobic activity, control impact stresses, or the like. The exercise apparatuses, in some embodiments, simulate climbing stairs while the user walks on generally flat surfaces. The exercise apparatuses can be used while performing numerous types of everyday activities, including housework, gardening, or the like.

In some embodiments, an exercise apparatus includes a pair of wearable exercise devices. Each exercise device is configured to be worn on a foot and is movable between an open configuration and a closed configuration such that the exercise device simulates a selected motion when the user travels by foot. In some embodiments, the exercise devices cooperate to simulate climbing stairs and, thus, may provide many of the same benefits as climbing stairs. Each exercise device, in some embodiments, has a restraint to couple the exercise device to a foot of the user. The user can wear the devices to travel over a wide range of different terrains. In some embodiments, the exercise devices are adjustable to control rates of expansion of the exercise devices, rates of collapse of the exercise devices, and the like. Other parameters (e.g., an amount of travel between an upper sole and a lower sole of an exercise apparatus) can also be adjusted.

One exercise device is worn on the user's right foot and another exercise device is worn on the user's left foot. When the user walks, the exercise device leaving the ground can move to the open configuration. When the user steps onto the open exercise device, the exercise device closes. The user's body is raised onto the opened exercise device before the exercise device has closed a significant amount. In this manner, two exercise devices cooperate to simulate a desired up and down motion, even though the user may be traveling along a generally flat surface. The exercise devices do not provide any appreciable propelling force, unlike traditional spring shoes. The user provides substantially all of the energy to move forward, as well as substantially all of the energy to step onto the exercise device. The user has to repeatedly raise his/her body by stepping onto the exercise devices. The devices discloses herein can have restoring forces that are minimized to limit propelling of the user forward and/or upward.

In some embodiments, an exercise device has one or more horizontally mounted energy absorbers, vertically mounted energy absorbers, or diagonally mounted energy absorbers. The exercise device may also have one or more linkage mechanisms. The linkage mechanisms may include one or more scissor joints. Outer parts of the linkage mechanism can be fixed to components of the device, and the ends of the inner portions of the linkage mechanism can have bearings and move along tracks or slots. In some embodiments, ends of energy absorbers are coupled directly to a one-piece or multi-piece sole.

The exercise devices, in some embodiments, are adjustable to select how quickly the devices will compress. Exercise devices can be collapsed for storage in relatively small spaces and can also be operable to limit or stop an exercise routine. For example, a user may want to limit or stop the step-up motion for a short period of time but may not want to remove the exercise devices. The exercise devices can have a locked in or expanded configuration and/or a collapsed configuration.

In some embodiments, a footwear apparatus for simulating climbing stairs while traveling along a generally flat surface includes a shoe main body wearable on a foot of a user, a foot retainer, and a collapsible step-up sole assembly. The sole assembly is coupled to the shoe main body by the foot retainer. The sole assembly includes a rigid elongate lower sole and a rigid elongate upper sole substantially parallel to the lower sole. The upper sole has a toe support region to support the user's toes and a heel support region to support the user's heel. The sole assembly further includes a first pair of rigid members extending transversely between the elongate lower sole and the elongate upper sole. Each of the rigid members has an upper end rotatably coupled to the upper sole and a lower end rotatably coupled to the lower sole. A first pivot pin extends through each of the rigid members. The sole assembly also includes a second pair of rigid members extending transversely between and being rotatably coupled to the lower sole and the upper sole. A second pivot pin extends through each of the rigid members of the second pair. An energy absorber is positioned between the first pair of rigid members and the second pair of rigid members. The energy absorber has an upper end rotatably coupled to the upper sole and a lower end rotatably coupled to the lower sole. The energy absorber is movable from an expanded configuration to a compressed configuration to provide a resistive force to control a rate of collapse of the sole assembly such that a distance between the lower sole and the upper sole is mostly reduced after most of a user's body mass is supported by the sole assembly. An opener assembly expands the sole assembly after the sole assembly has been at least partially collapsed.

The resistive force can be a dampening force that resists motion of the sole assembly. The energy absorber may not provide any appreciable forces when it expands. In some embodiments, the energy absorber resists motion in one direction or two directions. The opener assembly can provide a restoring force to expand the sole assembly. The restoring force can be sufficiently small to allow the sole assembly to collapse under the weight of the user but may be sufficiently large to expand the sole assembly.

In some embodiments, a footwear apparatus for simulating climbing stairs while traveling along a generally flat support surface includes a shoe main body wearable on a foot of a user and a collapsible sole assembly coupled to the shoe main body. The sole assembly includes a lower sole and an upper sole translatable with respect to the lower sole. The upper sole has a toe support region and a heel support region. The sole assembly further includes an adjustable lowering mechanism that provides a resistive force to inhibit collapse of the sole assembly such that a distance between the lower sole and the upper sole is mostly decreased after most of a user's body mass is supported by the sole assembly. An opener assembly is configured to push the upper sole away from the lower sole to expand the sole assembly after the sole assembly has been at least partially collapsed.

In other embodiments, an exercise device comprises a self-expanding sole assembly movable between an expanded configuration and a compressed configuration. The sole assembly comprises a lower sole, an upper sole movable with respect to the lower sole, and an expansion mechanism that generates a resistive force as the upper sole spaced apart from the lower sole moves towards the lower sole so as to move the sole assembly from the expanded configuration towards the compressed configuration. In some embodiments, the expansion mechanism is configured to generate a restoring force that is less than the resistive force to move the sole assembly from the compressed configuration towards the expanded configuration. The restoring force can be less than about 50%, 25%, 10%, or 5% of the maximum resistive force produced during use.

In yet other embodiments, an exercise device comprises a self-expanding sole assembly configurable between an expanded configuration and a collapsed configuration. The sole assembly generates a resistive force as the sole assembly in the expanded configuration moves towards the collapsed configuration and generates an expansion force to move from the collapsed configuration towards the expanded configuration. The expansion force, in some embodiments, is substantially less than the resistive force.

In some embodiments, an exercise system comprises a pair of step-up apparatuses wearable on a user's feet. Each step-up apparatus is configurable between an expanded configuration and a compressed configuration to simulate a selected motion when the user wearing the pair of step-up apparatuses travels by foot. In some embodiments, each of the step-up apparatuses substantially immediately collapses when a foot of the user transfers a substantial portion of the user's weight to the step-up apparatus and expands upon removal of the substantial portion of the user's weight without providing any appreciable propelling force. In certain embodiments, each of the step-up apparatuses collapses in less than about 1 second, 0.5 second, 0.1 second, or about 0.05 second after at least 25%, 50%, 75%, 90%, 95%, or all of the user's body weight (or mass) is supported by the apparatus. In some embodiments, the step-up apparatuses can have delay devices to ensure that a desired amount of the user's weight is supported by the apparatuses. The exercise apparatuses may thus begin to collapse after a desired delay period.

In other embodiments, an exercise device comprises an upper sole for supporting a foot of a user, a lower sole, and an actuating mechanism. The actuating mechanism movably couples the upper sole to the lower sole such that the exercise device is configurable between an expanded configuration and a collapsed configuration to define a maximum expansion distance. The actuating mechanism is operable to increase and/or decrease the maximum expansion distance of the exercise device. In some embodiments, the exercise device includes a controller operable to set the maximum expansion distance. The controller can adjust the maximum expansion distance based on signals from one or more sensors of the exercise device and/or based on user input.

In some embodiments, an exercise device comprises a sole assembly configured to support a user. The sole assembly includes an actuating mechanism operable to move the sole assembly from a collapsed configuration to an expanded configuration. In certain embodiments, the actuating mechanism has a first state of operation to provide a first rate of collapse and a second state of operation to provide a second rate of collapse that is different from the first rate of collapse.

In some embodiments, a system comprises a pair of exercise devices that can be opened and closed. An open exercise device can support most or substantially all of the user's body weight. In some embodiments, the open exercise device can support at least 60%, 80%, 90%, or 95% of the user's body mass without closing an appreciable amount. The user can stand on one foot, which is supported by the exercise device, as the exercise device closes. The user can operate the exercise devices to repeatedly raise and lower the user's body (e.g., the user's torso) to exercise. The distance the user's body is raised can be generally equal to the distances the exercise devices expand from a closed configuration to an open configuration. The exercise devices can be independently operated. For example, one exercise can close while the other exercise device opens.

In some embodiments, a method comprises stepping onto a pair of step-up apparatuses worn on feet of a user to move each step-up apparatus is between an expanded configuration and a compressed configuration. Each of the step-up apparatuses is expanded from the compressed configuration to the expanded configuration. In some embodiments, one of the step-up apparatus is moved from the expanded configuration and the compressed configuration while the other step-up apparatus is in the compressed configuration. The step-up apparatuses can move from the expanded configuration to the compressed configuration in more than about 0.05 second

BRIEF DESCRIPTION OF THE SEVERAL VIEWS OF THE DRAWINGS

Non-limiting and non-exhaustive embodiments are described with reference to the following drawings, wherein like reference numerals refer to like parts or acts throughout the various views unless otherwise specified.

DETAILED DESCRIPTION

The present detailed description is generally directed to exercise systems that can provide different types of routines, exercises, and motions. The system can be used to simulate climbing steps, climbing up a slope, traversing uneven surfaces, and the like. Many specific details and certain exemplary embodiments are set forth in the following description and in FIGS. 1-40 to provide a thorough understanding of such embodiments. One skilled in the art, however, will understand that the disclosed embodiments may be practiced without one or more of the details described in the following description. Additionally, exercise systems are discussed in the context of simulating climbing steps because they have particular utility in this context. However, the exercise systems and their components can be used to simulate other activities.

Figure 1:
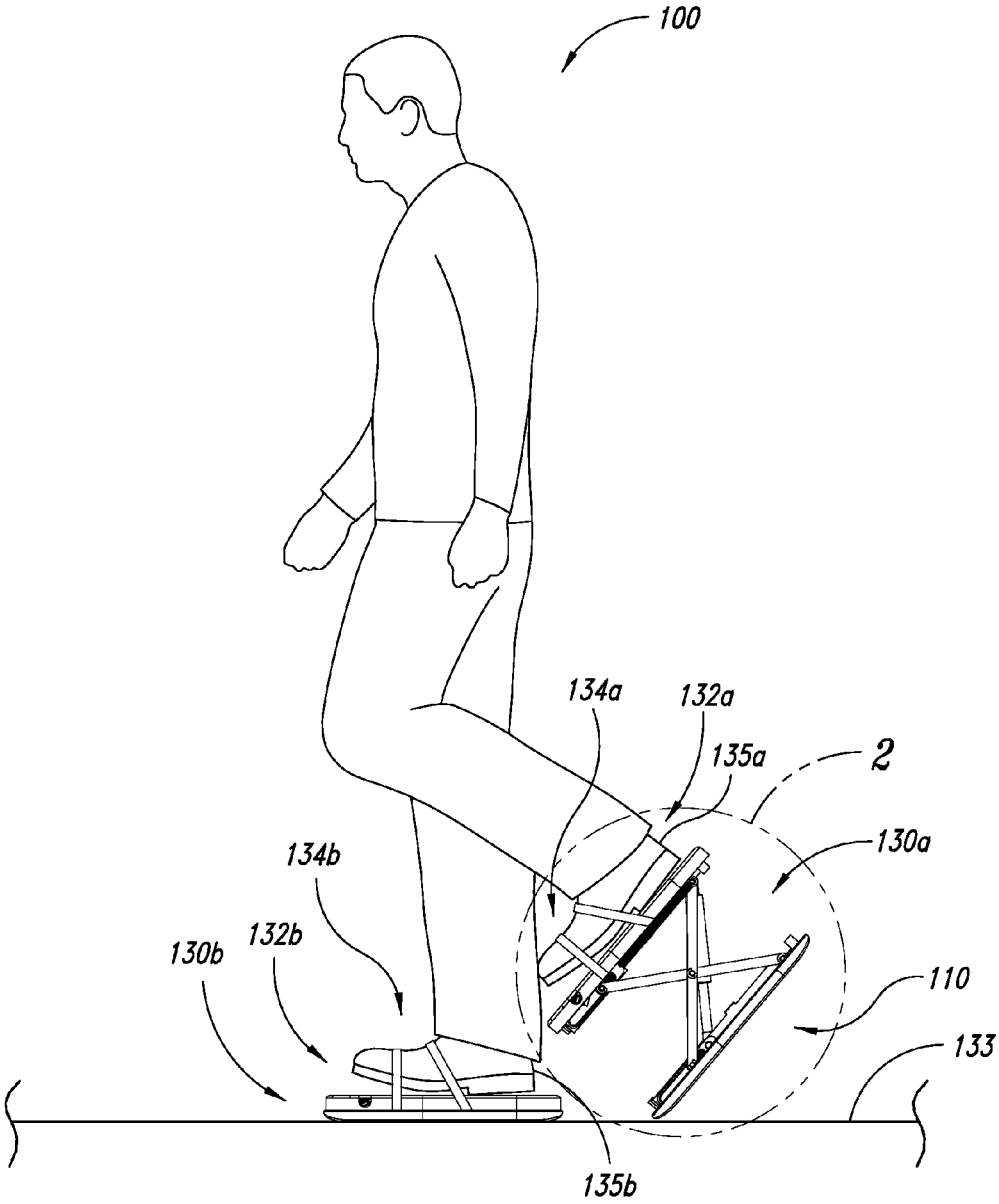
FIG. 1 is a pictorial view of a user wearing an exercise apparatus, in accordance with one embodiment.

FIG. 1 illustrates an individual 100 using an exercise apparatus 110. The exercise apparatus 110 includes a pair of exercise devices 130*a*, 130*b* (collectively 130) on the user's left foot 132*a* and right foot 132*b*, respectively. Each of the exercise devices 130 is configurable between an open configuration (see exercise device 130*a*) and a closed configuration (see exercise device 130*b*) to provide a selected motion when the user 100 travels along a support surface 133. When the user 100 alternatingly steps up and onto the open exercise devices 130, the exercise device 130 supporting the user's weight can move towards the closed configuration. The user's body is repeatedly lifted against gravity to exercise leg muscles and the buttocks. For example, the open exercise device 130*a* of FIG. 1 can be placed on the support surface 133. The user's body is raised onto the open exercise device 130*a*. The exercise device 130*a* supports the user 100 and moves (slowly or rapidly) to the closed configuration.

The exercise devices 130 tend to move from the closed configurations to the open configurations without any significant intervention by the user. The closed exercise device 130*b*, for example, can be lifted away from the support surface 133 to allow the exercise device 130*b* to self-expand. As the foot 132*b* is raised, the exercise device 130*b* automatically moves towards the open configuration.

The exercise devices 130 can be worn in a wide range of settings, including, without limitation, indoor settings, outdoor settings, or the like to travel by foot over different types of terrain to simulate traveling up a slope, stairs, and other uneven surfaces so as to enhance aerobic exercise, muscle tone, muscle building, and/or strength training. The exercise devices 130, for example, can be worn while stepping in place, walking, running, jogging, or performing other normal physical activities and can target certain muscles and can increase or decrease impact forces and/or level of intensity.

With continued reference to FIG. 1, shoe main bodies 135*a*, 135*b* (collectively 135) can be worn on the feet 132*a*, 132*b*. The shoe main bodies 135 can be athletic shoes, boots, sandals, or other footwear for covering the user's feet. In some embodiments, the shoe main bodies 135 are in the form of athletic shoes, such as tennis shoes. In other embodiments, the shoe main bodies 135 are integrated into the exercise devices 130, as discussed in detail below.

Figure 2:
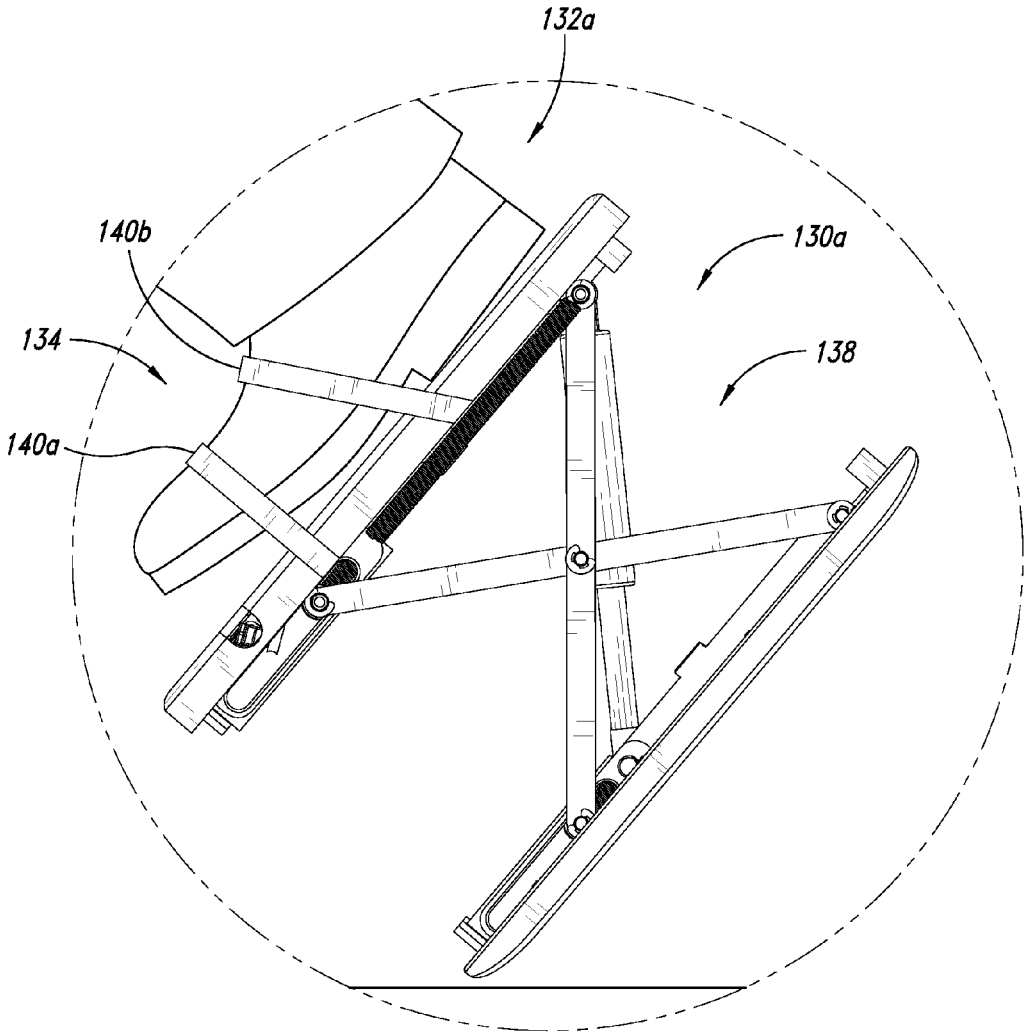
FIG. 2 is a detailed view of an exercise device worn on a foot of the user of FIG. 1.

FIG. 2 shows the exercise device 130*a* including a self-expanding sole assembly 138 and a foot retainer 134. The exercise device 130*a* can be generally similar to the exercise device 130*b* and, accordingly, the following description of one of the exercise devices applies equally to the other, unless indicated otherwise.

The foot retainer 134 includes a plurality of coupling members 140*a*, 140*b* (collectively 140), illustrated in the form of straps that can be opened or closed. The coupling members 140 can be configurable between a foot retaining configuration of FIG. 2 and a foot receiving configuration of FIG. 3. The coupling members 140 can include, without limitation, one or more fasteners for opening and closing. The fasteners can be, without limitation, snaps, buckles, hook and loop type fasteners, or the like. Mechanical assemblies (e.g., nut and bolt assemblies), adhesives, or other coupling features can couple the coupling members 140 to the sole assembly 138. Additionally or alternatively, the foot retainer 134 can include, without limitation, bindings, clips, or other types of components suitable for receiving and retaining the foot 132*a*.

Figure 3:
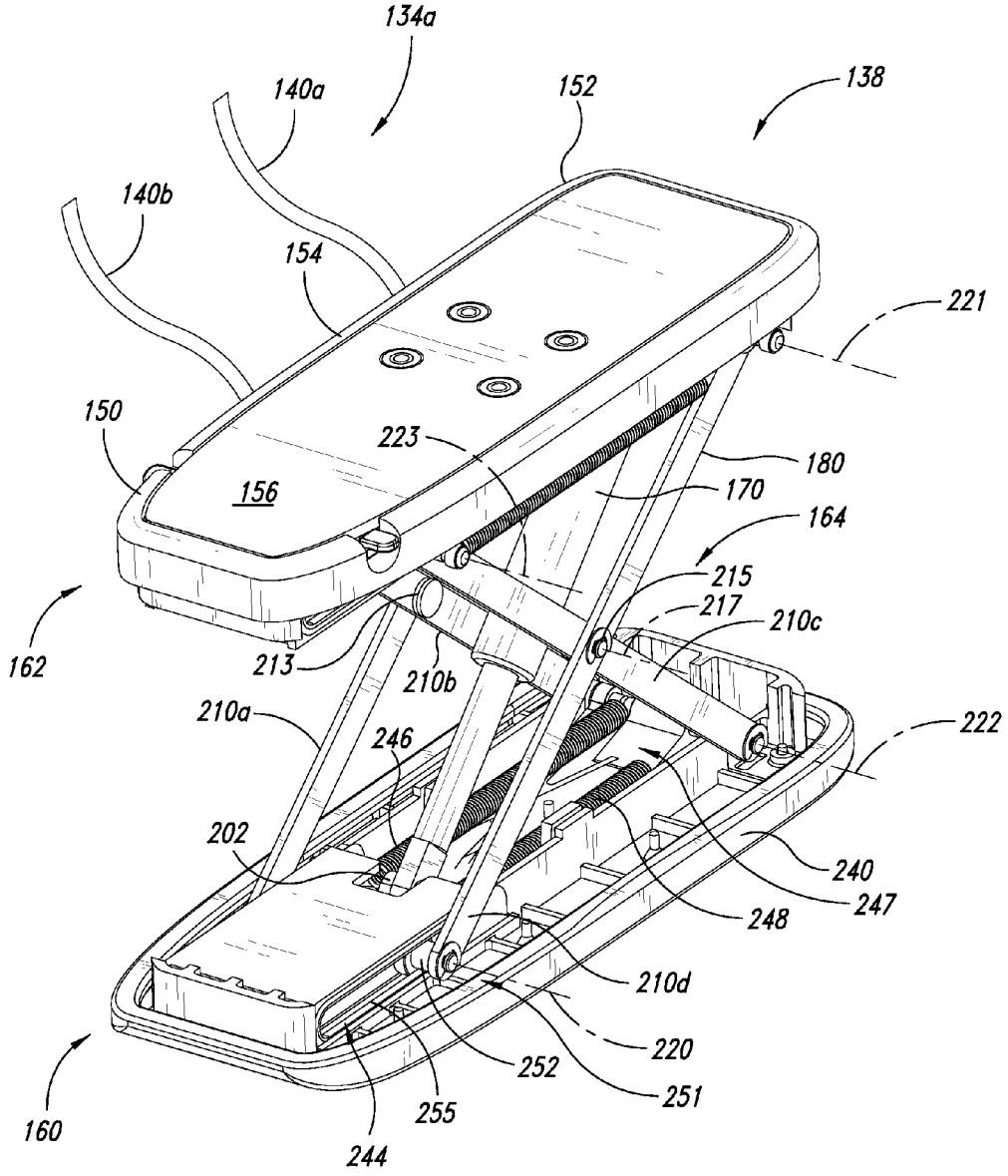
FIG. 3 is a front, top, and left side pictorial view of an exercise device, in accordance with one embodiment.

FIG. 3 shows the sole assembly 138 that generally includes a lower sole 160, an upper sole 162, and an actuating mechanism 164 connecting the lower sole 160 to the upper sole 162. The lower and upper soles 160, 162 are generally planar elongate members and can include one-piece or multi-piece plates, trays, or platforms made, in whole or in part, of one or more metals, plastics, polymers, composites, or other generally rigid materials suitable for repeatedly impacting support surfaces and/or withstanding cyclic loading. For example, a main body 240 of the lower sole 160 can be made of a rigid plastic (e.g., polyethylene, polypropylene, polystyrene, or combinations thereof) or a composite material (e.g., a fiber reinforced composite).

The lower sole 160 is generally parallel to the upper sole 162. If the lower sole 160 rests on a horizontal surface, the upper sole 162 can be in a substantially horizontal orientation. The soles 160, 162 can remain substantially parallel as the sole assembly 138 expands and collapses. The orientations and relative positions of the lower and upper soles 160, 162 can be selected based on the desired position of the user's foot with respect to the ground.

The upper sole 162 includes a toe support region 150, a heel support region 152, and a central region 154 extending between the toe support region 150 and the heel support region 152. The toe support region 150 is positioned to be directly beneath the user's toes. The heel support region 152 is positioned to be directly beneath the user's heel. The upper sole 162 further includes a substantially flat surface 156 upon which the user 100 stands. Tread or other types of surface treatments for enhancing traction can be provided on the surface 156.

When a downwardly directed force is applied to the upper sole 162, the actuating mechanism 164 can be collapsed at a selected rate. The actuating mechanism 164 can include various types of mechanical devices that provide relative movement between the lower and upper soles 160, 162. For example, one or more biasing members, pneumatic cylinders, hydraulic devices, electromechanical systems, dampeners, piston devices (e.g., piston type members that extend and contract when the exercise device opens and closes), energy absorbers, and other types of devices (e.g., air and/or liquid filled devices) can allow such movement.

Figure 4A:
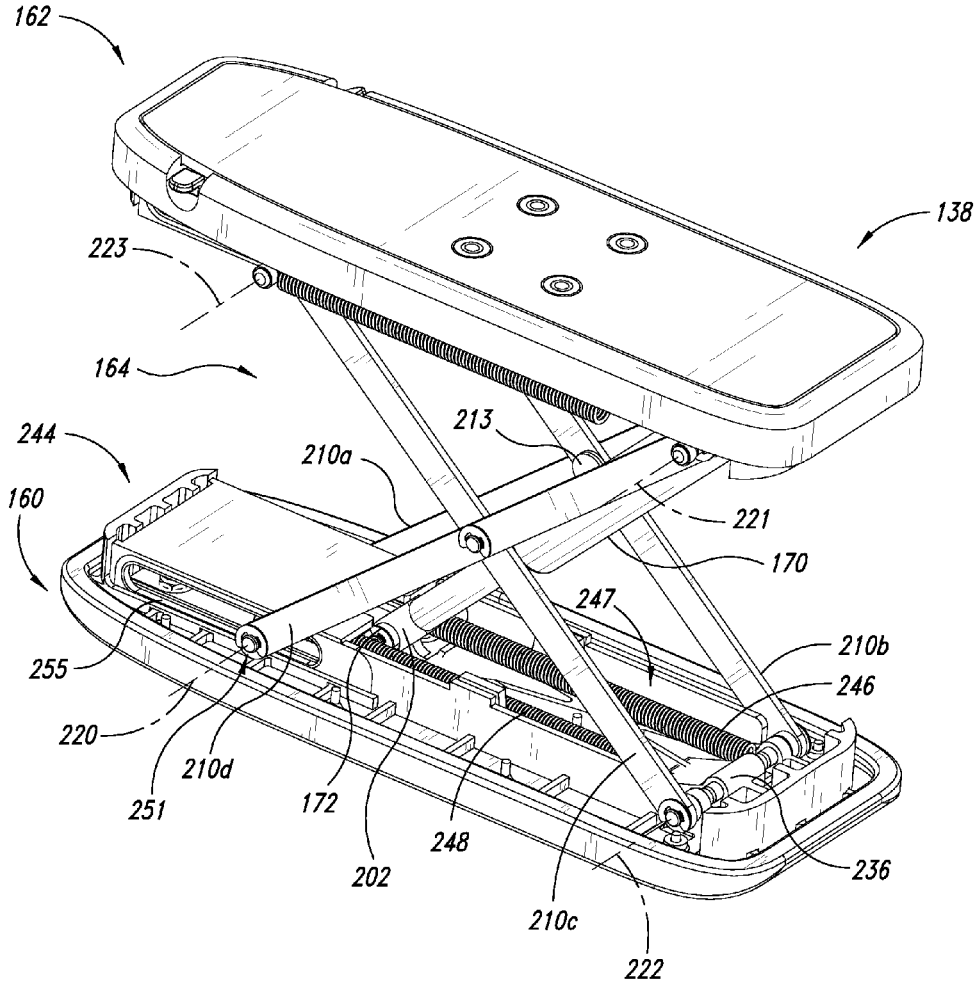
FIG. 4A is a rear, top, and left side pictorial view of the exercise device of FIG. 3.
Figure 4B:
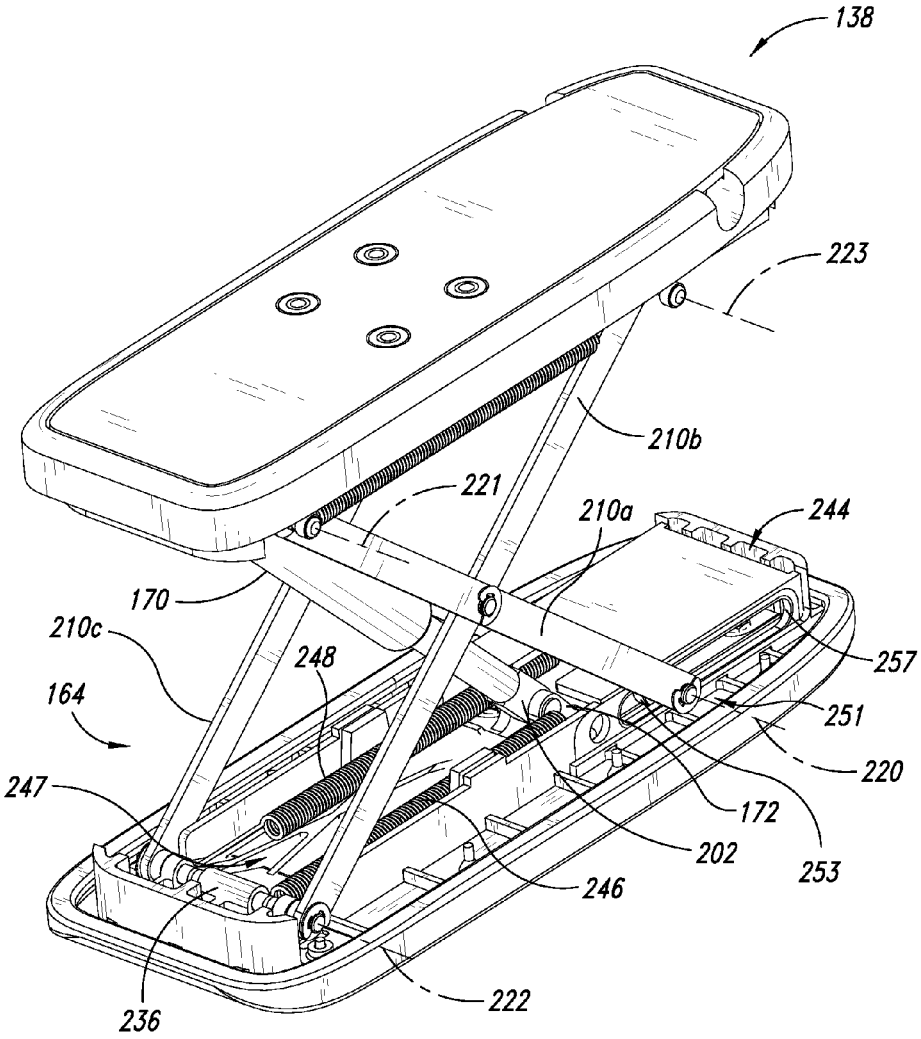
FIG. 4B is a rear, top, and right side pictorial view of the exercise device of FIG. 3.
Figure 5:
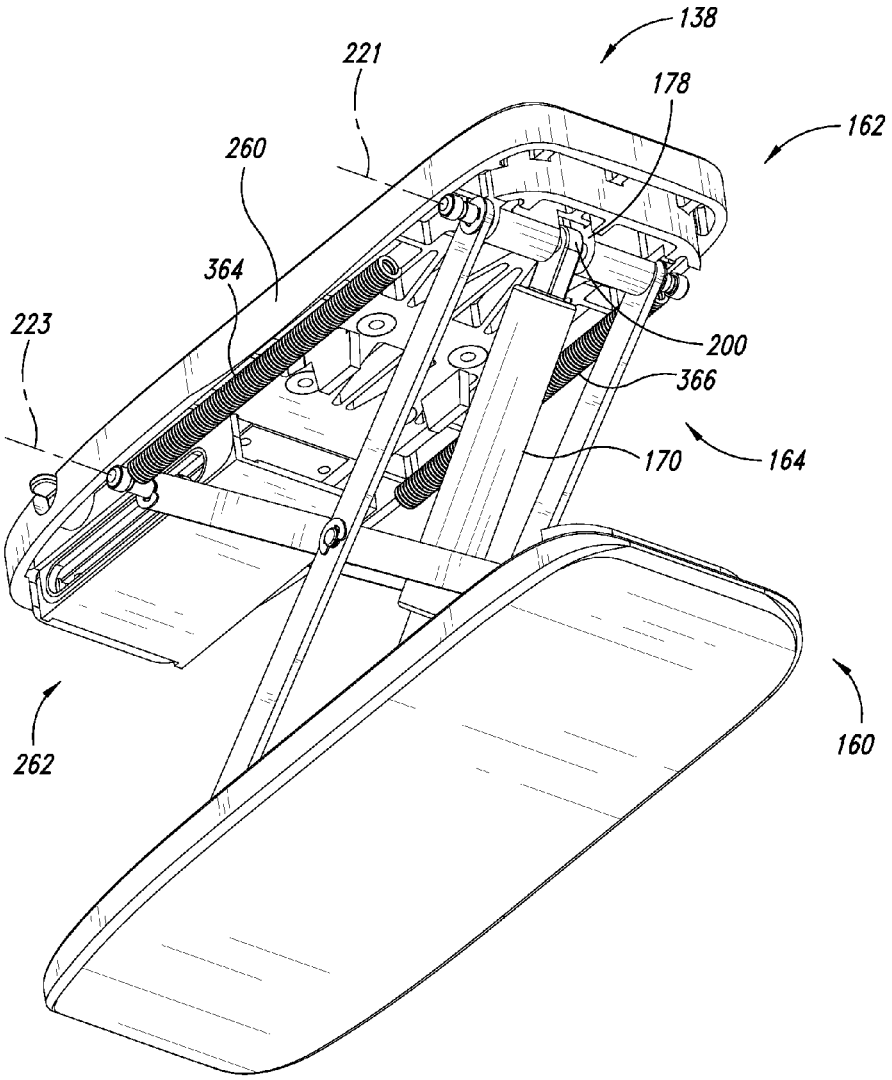
FIG. 5 is a rear, bottom, and left side pictorial view of the exercise device of FIG. 3.

Referring to FIGS. 3-5, the actuating mechanism 164 includes an energy absorber 170 with an upper end 200 (see FIG. 5) rotatably coupled to a pivoting mechanism 178 of the upper sole 162 and a lower end 202 (see FIGS. 3, 4A, and 4B) rotatably coupled to a pivoting mechanism 172 of the lower sole 160. The energy absorber 170 can be in the form of one or more shock absorbers (e.g., twin tube shock absorbers, gas shocks, or the like), dampeners (e.g., one-way dampeners), biasing members, pneumatic cylinders, hydraulic cylinders, or other selectively actuatable devices for absorbing energy. The illustrated energy absorber 170 is a piston (e.g., an expandable piston assembly) movable from an expanded configuration to a compressed configuration to provide a resistive force that acts against a force applied by the user pressing on the upper sole 162. The resistive force (e.g., a dampening force, a non-active force, etc.) is used to resist motion, for example, downward movement of the upper sole 162. The resistive force may not be generated during expansion of the energy absorber. In some embodiments, the energy absorber 170 resists motion during compression and does not resist motion during expansion. Thus, the energy absorber 170 may freely expand to allow the upper sole 162 to move upwardly. An expandable piston assembly can include, without limitation, one or more biasing members (e.g., helical springs, coil springs, or the like), fluid valves, pressurization devices, sensors, or the like that cooperate to provide the desired resistive force. The resistive force can be a constant resistive force or variable resistive force.

Referring to FIG. 3, a frame 180 of the actuating mechanism 164 provides a relatively stable upper sole 162 that experiences limited side-to-side movement during use. The upper sole 162 can remain generally aligned with the lower sole 160 as the user's weight is placed on the upper sole 162. Free ends of the frame 180 are slidable along the lower and upper soles 160, 162. The frame 180 can be a linkage mechanism that generally includes elongate members 210*a*, 210*b*, 210*c*, 210*d* (collectively 210). The pair of elongate members 210*a*, 210*b* and the pair of elongate members 210*c*, 210*d* form scissor-type joints. The elongate members 210*a*, 210*b* extend transversely between right sides of the lower and upper soles 160, 162. A pivot pin 213 extends through overlapping sections of the elongate members 210*a*, 210*b* such that the elongate members 210*a*, 210*b* rotate with respect to one another about an axis of rotation 217. The elongate members 210*c*, 210*d* extend transversely between left sides of the lower and upper soles 160, 162. A pivot pin 215 extends through overlapping sections of the elongate members 210*c*, 210*d* such that the elongate members 210*c*, 210*d* rotate with respect to one another about the axis of rotation 217.

Pivoting mechanisms 178, 236 (see FIGS. 4A, 4B, and 5) define the vertically spaced apart axes of rotation 221, 222, respectively. The elongate members 210*a*, 210*d* are rotatable about the axis of rotation 221, and the elongate members 210*b*, 210*c* are rotatable about the axis of rotation 222.

Referring to FIGS. 3 and 4B, a guide assembly 244 and an opener assembly 247 cooperate to translate a roller assembly 251 along elongate slots 255, 257. The elongate members 210*a*, 210*d* are coupled to the roller assembly 251 and rotatable about an axis of rotation 220 as the roller assembly 251 moves along the slots 255, 257. Rollers 252, 253 of the roller assembly 251 can roll smoothly along the edges of the slots 255, 257. The opener assembly 247 includes a pair of biasing members 246, 248 that pull the roller assembly 251 rearwardly. The opener assembly 247 can also include connectors, couplers, levers, gears, or the like, if needed or desired.

Figure 6:
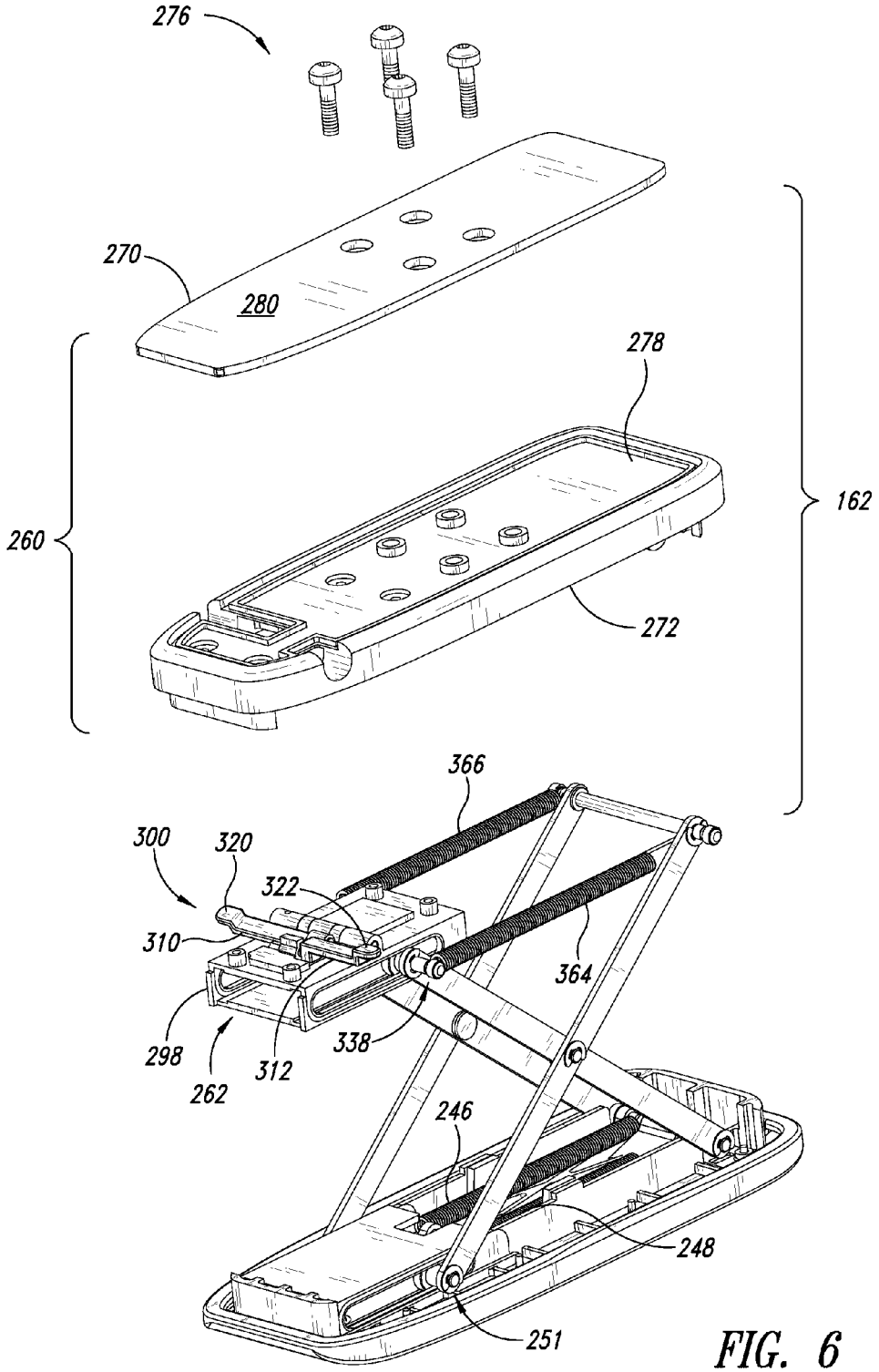
FIG. 6 is a partially exploded view of the exercise device of FIG. 3.

FIGS. 5 and 6 show the upper sole 162 including a multi-piece main body 260 and a guide assembly 262. The main body 260 includes a support plate 270 that sits in a recessed platform 272. A plurality of fasteners 276 can temporarily or permanently couple the plate 270 to the recessed platform 272. The plate 270 can have an upper surface 280 that provides desired frictional interaction. If the plate 270 becomes worn or damaged, it can be replaced with another plate. A recessed region 278 of the platform 272 can receive the support plate 270 to minimize, limit, or substantially prevent relative movement of the plate 270 with respect to the platform 272.

The guide assembly 262 is generally similar to the guide assembly 244 except as detailed below. The guide assembly 262 of FIG. 6 can be physically coupled to the bottom of the platform 272 and includes an adjustment mechanism 300 for controlling the amount of travel of the exercise device. The adjustment mechanism 300 includes a pair of control levers 310, 312. Buttons 320, 322 of the levers 310, 312, respectively, can extend outwardly from the platform 272. A user can conveniently access the buttons 320, 322 to manually move the levers 310, 312.

Figure 7:
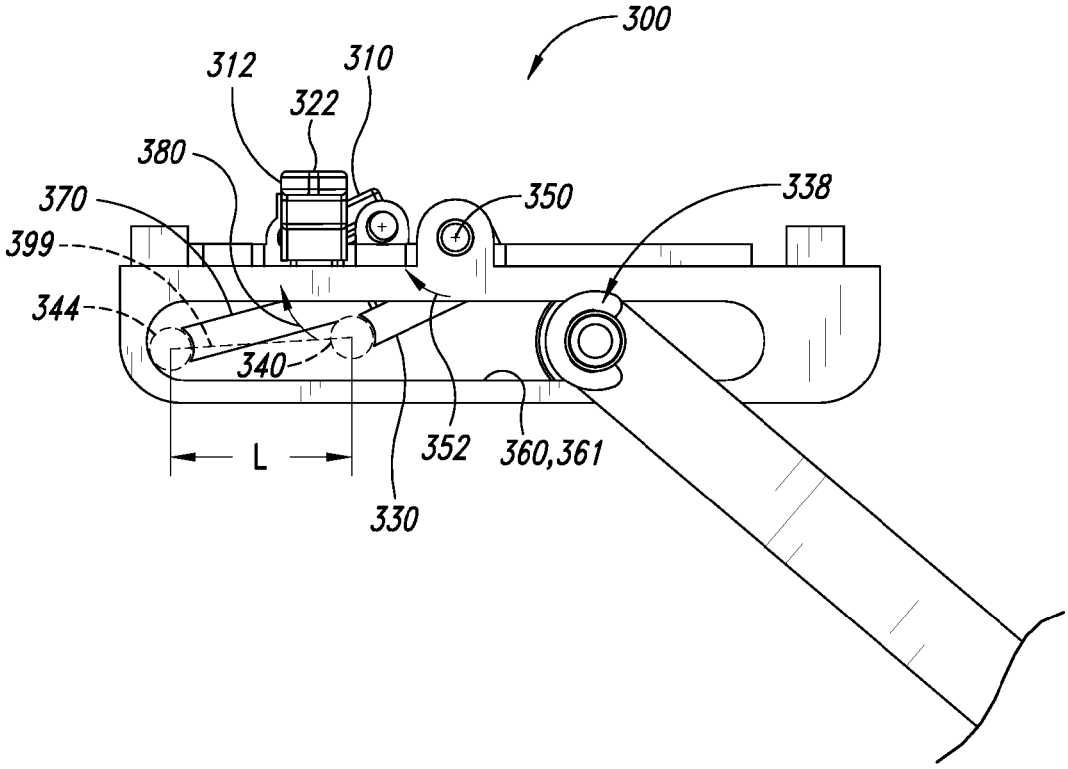
FIG. 7 is a side elevational view of an adjustment mechanism, in accordance with one embodiment.

FIG. 7 shows travel stops 330, 370 of the adjustment mechanism 300 for limiting travel of a roller assembly 338. The travel stop 330 serves as a mid-level travel stop, and the travel stop 370 serves as a low-level travel stop. The lever 310 can rotate the stop 330 between an engagement position (illustrated in FIG. 7) and a disengagement position. When the stop 330 is in the engagement position, a shaft 336 (see FIG. 8) of the roller assembly 338 can travel along a path 399 between an initial position 344 and a stop position 340. The stop 330 can rotate about an axis of rotation 350, as indicated by an arrow 352, to move the stop 330 to the disengagement position. When the stop 330 is in the disengagement position, the roller assembly 338 can travel rearward past the stop 330.

The stop 330 can be a generally rectangular member positioned within a rectangular window 450 (see FIG. 9) of the stop 370. The dimensions of the stop 330 can be selected to obtain a desired length L of the path 399. The length L of the path 399 can be increased or decreased to increase or decrease, respectively, the amount of travel of the upper sole 262.

The stop 370 of FIG. 7 can keep the exercise device 130 in a generally closed configuration or low-level travel mode. The lever 312 can rotate the stop 370 about the axis of rotation 350, as indicated by the arrow 380, to a disengagement position (see FIG. 8). When both stops 330, 370 are in the disengagement positions, they can lie generally along the same plane. The roller assembly 338 can freely travel between opposing ends of the slots 360, 361.

Figure 9:
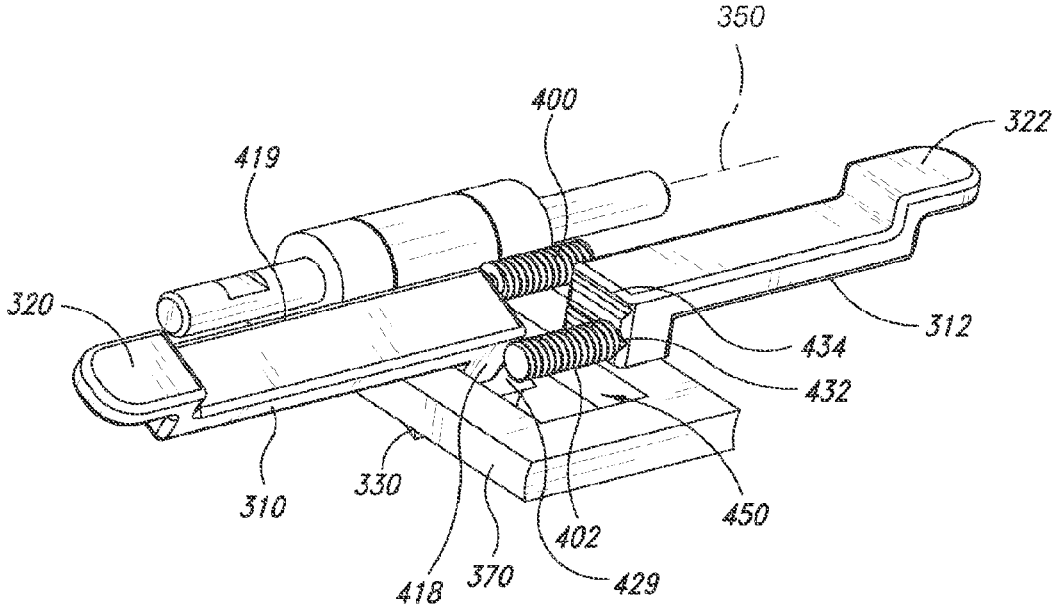
FIG. 9 is a pictorial view of components of the adjustment mechanism of FIG. 7.
Figure 10:
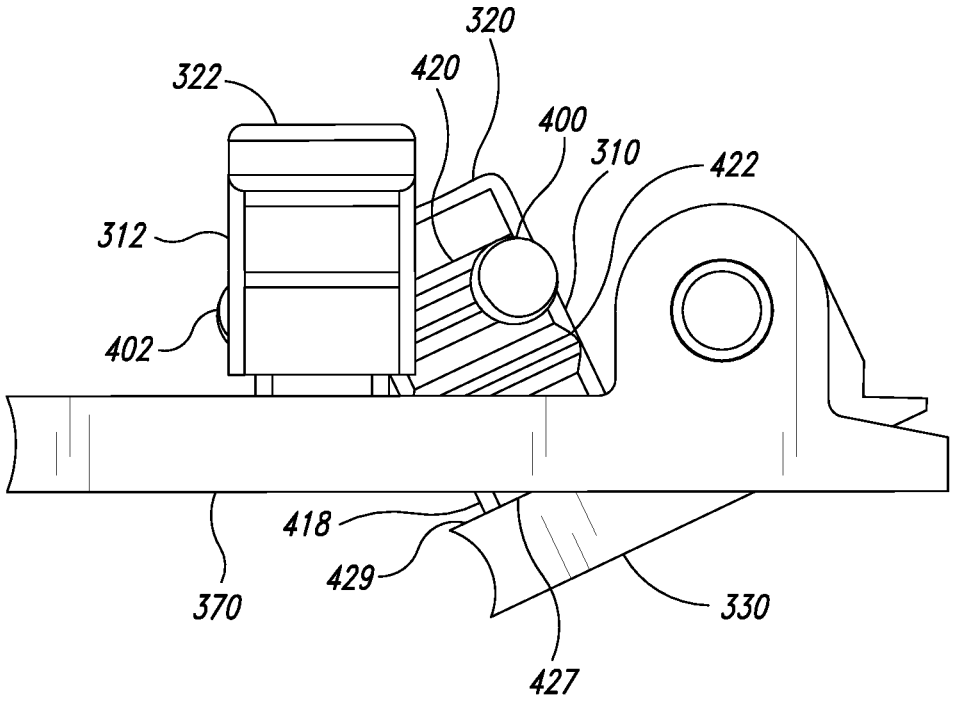
FIG. 10 is a side elevational view of the components of FIG. 9.
Figure 11:
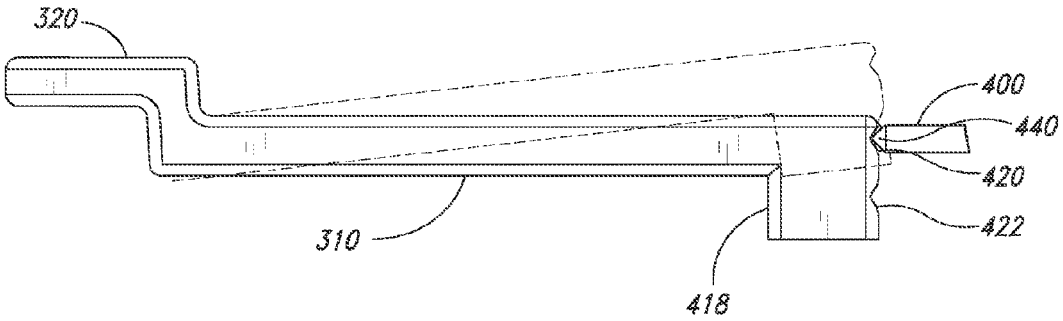
FIG. 11 is an elevational view of a control lever and a pin, in accordance with one embodiment.

FIGS. 9 and 10 show the levers 310, 312 that can be generally similar to each other and, accordingly, the following description of one of the levers applies equally to the other, unless indicated otherwise. The lever 310 includes a head 418 extending from an elongate arm 419. An end 427 of the head 418 contacts an upper surface 429 of the stop 330.

Pins 400, 402 physically engage and position the levers 310, 312, respectively. In some embodiments, including the illustrated embodiment of FIGS. 9-11, the pin 400 is stationary and holds the lever 310 in a lowered position by engaging an upper slot 420 (e.g., a groove, a recessed region, etc.) of the head 418. To move the lever 310 to a raised position (illustrated in dashed line in FIG. 11), a user presses the button 320 to move a tip 440 of the pin 400 out of the slot 420 and into a slot 422. The pin 402 is movable between slots 432, 434. The pin 400 holds the lever 310 in the raised position until the user moves the head 418 in the opposite direction.

Figure 12:
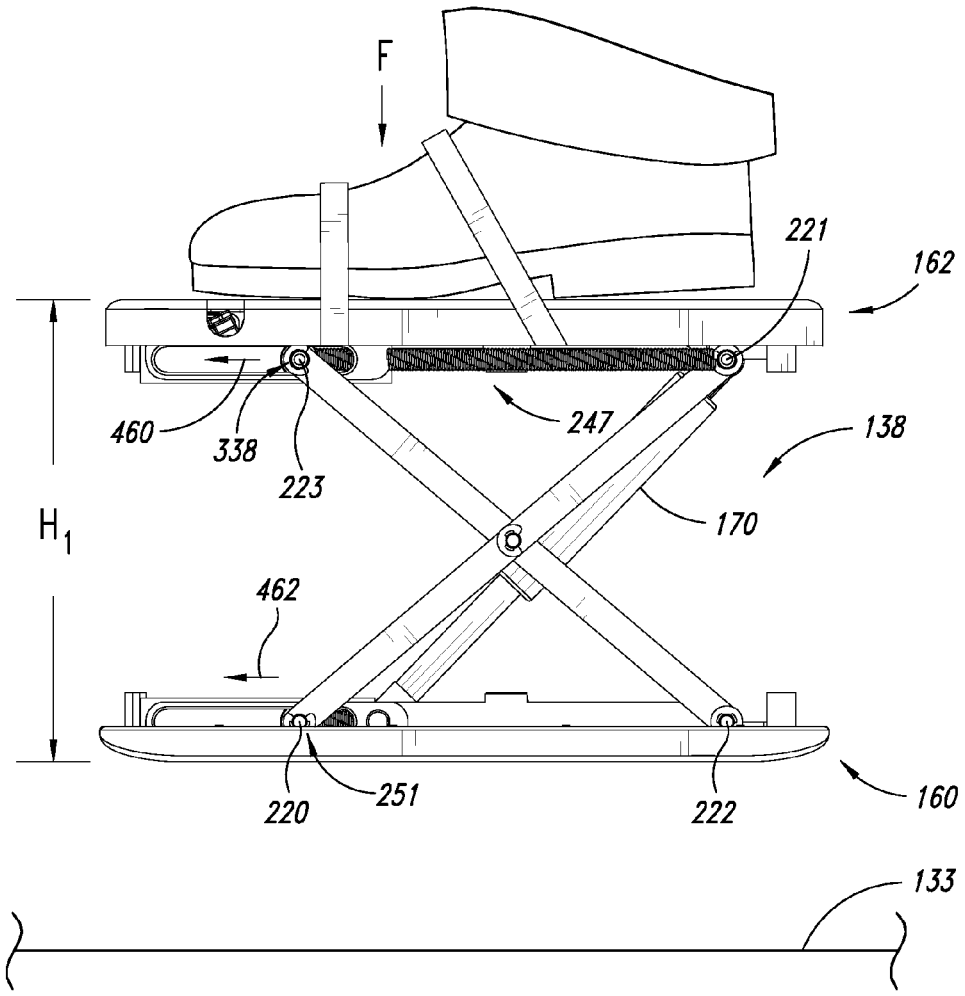
FIG. 12 is a side elevational view of an exercise device in an open configuration.
Figure 13:
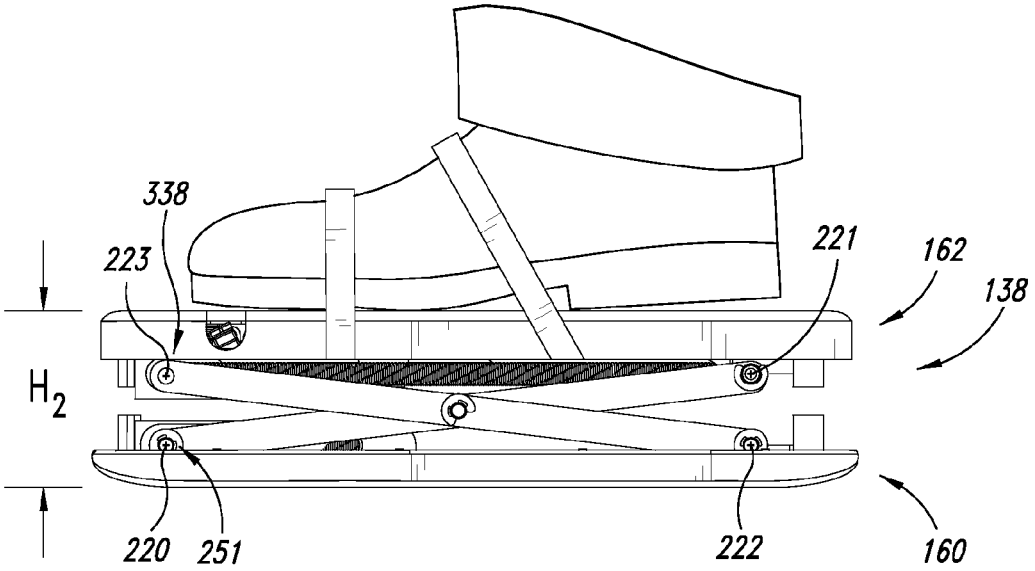
FIG. 13 is a side elevational view of the exercise device of FIG. 12 in a closed configuration.

FIGS. 12 and 13 show the sole assembly 138 in an expanded configuration and a collapsed configuration, respectively. The sole assembly 138 in the expanded configuration defines a raised height $H_1$ and in the collapsed configuration defines a lowered height $H_2$. The difference between the raised height $H_1$ and the lowered height $H_2$ defines a step-up height. The step-up height is thus the distance of travel of the upper sole 162 and can be equal to or greater than about 1 inch (2.5 cm), 2 inches (5 cm), 3 inches (7.6 cm), 4 inches (10.2 cm), 4.5 inches (11.4 cm), 6 inches (15.2 cm), 8 inches (20.3 cm), 10 inches (25.4 cm), 12 inches (30.5 cm), or ranges encompassing such heights. Of course, other step-up heights are also possible, if needed or desired.

The step-up height can be increased or decreased to increase or decrease the intensity of the aerobic activity. For a relatively strenuous workout for strengthening muscles, the step-up height can be more than about 5 inches. For a less strenuous workout with high aerobic activity, the step-up height can be less than about 5 inches (12.7 cm). The adjustment mechanism 300 (see FIG. 7) can be used to increase or decrease the step-up height. The illustrated adjustment mechanism 300 lowers the raised height $H_1$ to decrease the step-up height. In other embodiments, the adjustment mechanism 300 can raise the lowered height $H_2$ so as to decrease the step-up height.

When a user applies a force F to the expanded sole assembly 138 to overcome the bias (e.g., a restoring force) provided by the opener assembly 247, the sole assembly 138 begins to collapse. The restoring force can be small enough to allow the sole assembly 138 to completely collapse but can be large enough to cause expansion of the sole assembly 138 when the sole assembly 138 is unloaded. In contrast to traditional spring shoes, the sole assembly 138 can be fully collapsed without generating an appreciable restoring force. The restoring force, if any, can be less than about 50%, 20%, 10%, 5%, or 2% of the maximum resistive force. As such, the sole assembly 138 does not provide any significant propelling force that can noticeably push a user away from the ground. Because the sole assembly 138 does not provide any appreciable propelling forces (e.g., forward and/or upward forces), the user has to lift his/her leg to move a foot and/or the exercise device. The roller assemblies 251, 338 translate forwardly in a direction (see arrows 460, 462) that is generally parallel with longitudinal axes of the lower and upper soles 160, 162. The axes of rotation 223, 221 are moved away from each other and the axes of rotation 220, 221 are moved away from each other as the sole assembly 138 collapses.

The opener assembly 247 can bias the sole assembly 138 to the expanded configuration. The upper sole 162 can translate away from the lower sole 160 as the biasing members 246, 248, 364, 366 (see FIG. 6) move the roller assemblies 251, 338 rearward. The expansion force provided by the opener assembly 247 can be substantially less than the resistive force provided by the energy absorber 170. A user can conveniently move the exercise device 130 to the collapsed configuration while the biasing members 246, 248, 364, 366 pull the roller assemblies 251, 338. For example, the expansion force may be equal to or less than about 30%, 20%, 10%, or 5% of the resistive force provided by the energy absorber 170. The resistive force can be selected to have the exercise device 130 close in about 5 seconds, 3 seconds, 2 seconds, 1 second, 0.5 seconds, or 0.25 seconds or ranges encompassing such lengths of time, when a user stands on the exercise device 130. In some embodiments, the sole assembly 138 can substantially immediately collapse when the foot of the user transfers a substantial portion of the user's weight to the step-up apparatus and expands upon removal of the substantial portion of the user's weight, preferably without providing an appreciable propelling force. In certain embodiments, each of the apparatuses collapses within about 1 second, 0.5 second, 0.1 second, or 0.05 second after supporting at least 25%, 50%, 75%, 90%, or 90% of the user's body weight (or mass). In contrast to spring shoes that tend to propel a user forward and/or upward, the sole assembly 138 does not provide any such propelling force. The sole assembly 138 can be opened with a restoring force that is less than about 10%, 5%, 2%, or 1% of the user's body weight.

Figure 14:
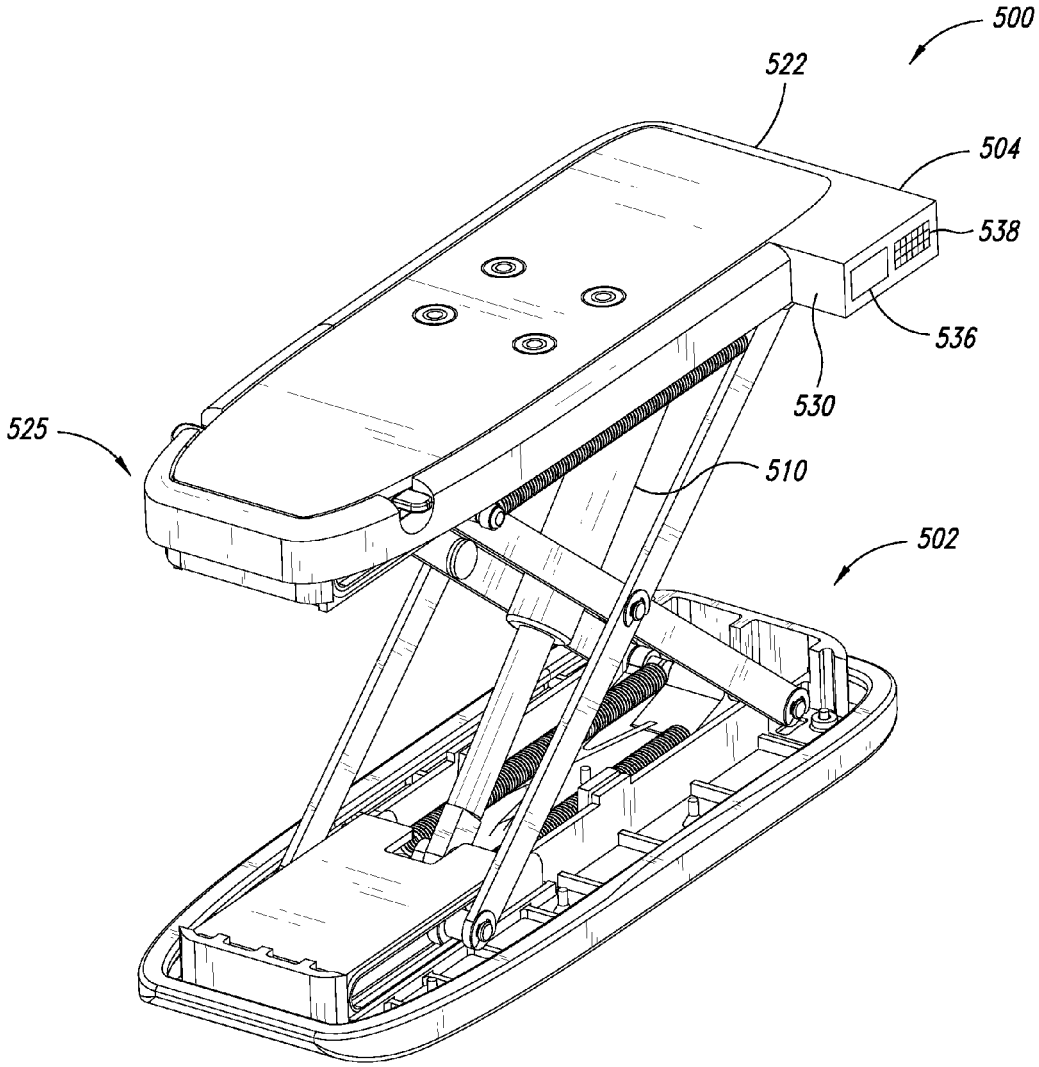
FIG. 14 is a pictorial view of an exercise device with a controller, in accordance with one embodiment.
Figure 15:
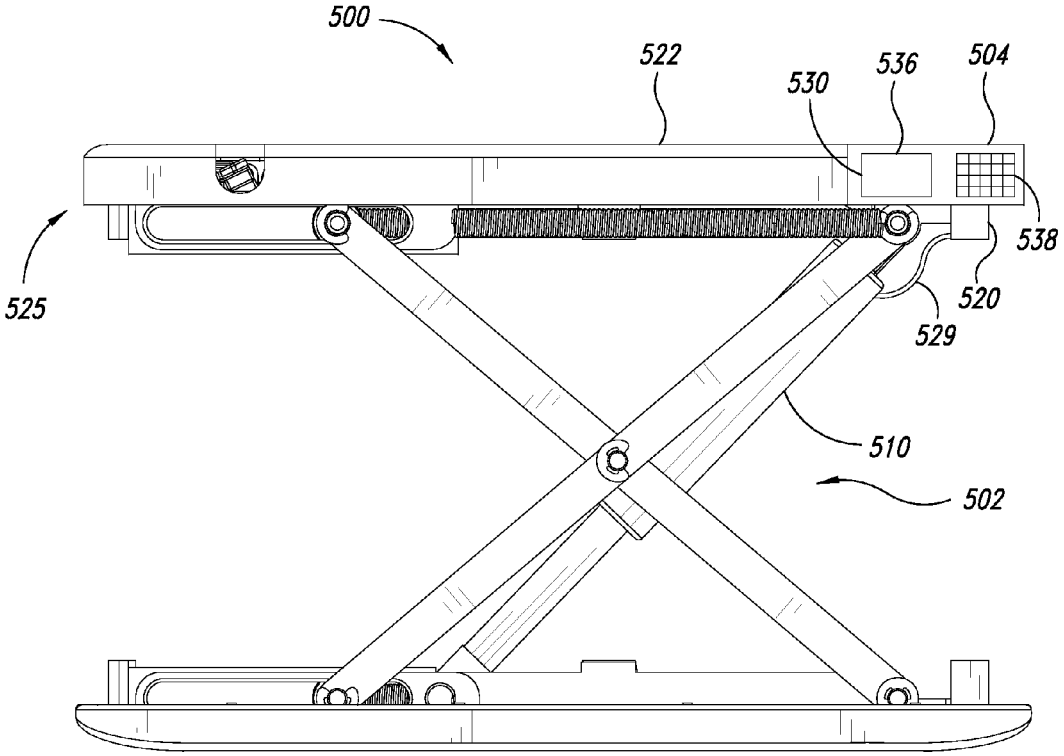
FIG. 15 is a side elevational view of the exercise device of FIG. 14.

FIGS. 14 and 15 show an exercise device 500 that includes a controller 504 adapted to control operation of an adjustable energy absorber 510. The energy absorber 510 is coupled to a pressurization device 520 via a fluid line 529. To increase the force required to compress the energy absorber 510, the pressurization device 520 can deliver fluid (e.g., air, water, oil, hydraulic fluid, or the like) through the line 529 and into an internal fluid chamber of the energy absorber 510. The pressure in the internal fluid chamber can be increased or decreased to increase or decrease the resistive force provided by the energy absorber 510.

The pressurization device 520 can include, without limitation, one or more compressors, pumps, valves (e.g., gate valves, check valves, duck bill valves, globe valves, ball valves, or the like), or other components that can cooperate to control operation of the energy absorber 510. The pressurization device 520 is coupled to a main body 522 of an upper sole 525. In other embodiments, the pressurization device 520 is incorporated into or coupled to the energy absorber 510, or other component of the exercise device 500.

With continued reference to FIGS. 14 and 15, the controller 504 may be conveniently accessed by a user to control operation of the exercise device 500 and may include a housing 530, a display 536, and an input device 538. The display 536 can be a screen or other display device. The input device 538 can include, without limitation, one or more buttons, keyboards, input pads, buttons, control modules, or other suitable input devices. The illustrated input device 538 is in the form of an input pad, such as a touch pad, used to program the controller 504.

The controller 504 can generally include, without limitation, one or more central processing units, processing devices, microprocessors, digital signal processors (DSP), application-specific integrated circuits (ASIC), readers, and the like. To store information, the controller 504 can also include, without limitation, one or more storage elements, such as volatile memory, non-volatile memory, read-only memory (ROM), random access memory (RAM), and the like. The controller 504 can be programmed based on the desired exercise programs to be performed. The controller 504 can store one or more programs for controlling the operation of a sole assembly 502. The input device 538 can also be used to switch between different programs, modes of operation, or the like. Different programs can be used to perform different types of activities (e.g., walking, running, jogging, or the like), different simulations (e.g., climbing stairs, walking on sand or gravel, or the like), control exercise intensity, target desired muscles (e.g., quadriceps, hamstrings, gluteal muscles, hip flexors, calves, or the like), or to achieve certain criteria (e.g., target heart rate, adjust supination/under-pronation, or the like). The controller 504 can control parameters of operation (e.g., rate of collapse, rate of expansion, distance of travel, orientations of the upper and lower soles, or the like). For example, the rate at which the exercise device 500 collapses when the user's body is raised onto the extended exercise device 500 can be selectively increased or decreased. In some embodiments, the exercise device 500 can provide a delayed collapse and/or a selected distance of vertical travel, such as about 2 inches to about 8 inches (about 5 cm to about 20.3 cm) of travel.

The controller 504 can generate a wide range of data, programs, or settings (e.g., force settings, height settings, or the like) used to control the exercise device. To calibrate the exercise device 500, the user can wear the exercise device 500 so that sensors send signals to the controller 504. The signals are used to determine force settings, generate control maps or curves (similar to the force curves and height curves shown in FIGS. 27-31) using a wide range of curve fitting techniques. Curve fitting can be based on polynomials, trigonometric functions, and combinations thereof to generate a curve approximating the collected data from the sensors. The generated information (e.g., data, maps, curves, etc.) can then be used to operate the exercise device 500.

If multiple users use the exercise device 500, the exercise device 500 can run unique programs for each user. The exercise device 500 can be recalibrated at any time to enhance performance. Calibration programs can be used to calibrate based at least in part on forces applied by the user, characteristics of motion (e.g., length of stride, cadence, or the like), characteristics of the user (e.g., weight, height, flexibility, etc.), and other exercise parameters.

Figure 16:
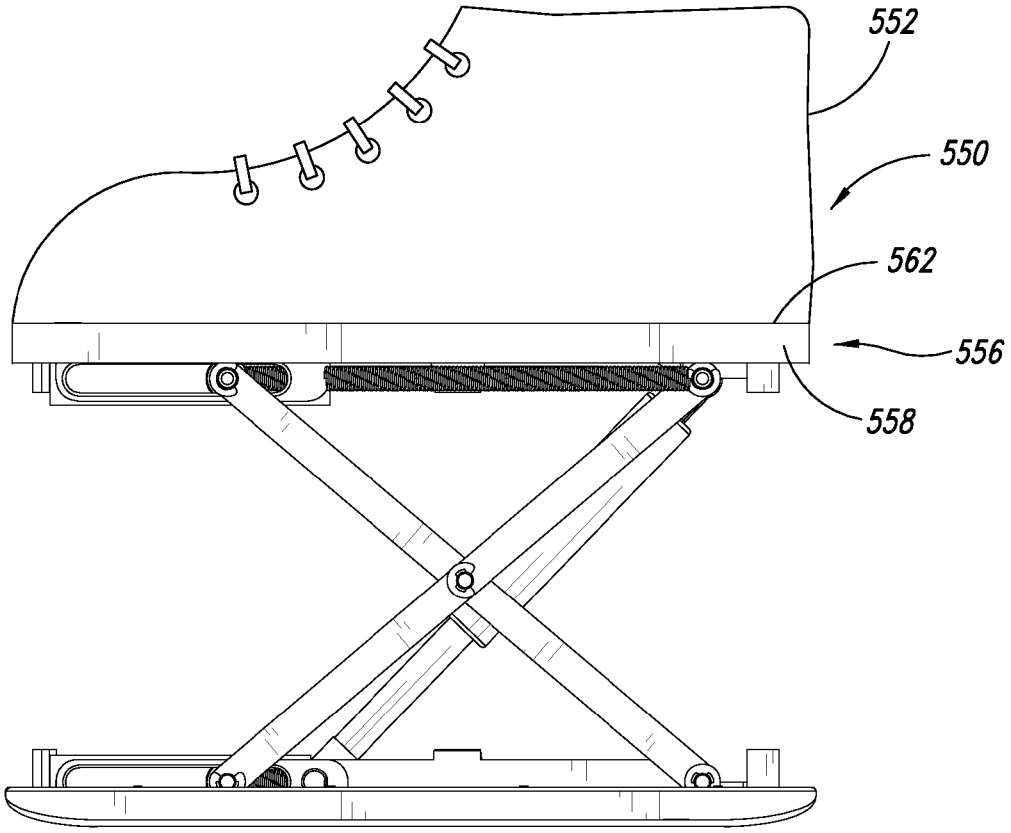
FIG. 16 is a side elevational view of an exercise device in an open configuration, in accordance with one embodiment.

FIG. 16 is a side elevational view of an exercise device 550 that includes a shoe main body 552 integrally formed with an upper sole 556 to minimize, limit, or substantially eliminate relative movement between the user's foot and a main body 558 of the upper sole 556. The exercise device 550 is especially well suited for relatively fast travel by foot (e.g., a brisk walk). A bottom 562 of the shoe main body 552 can be permanently coupled to the upper sole 556 via one or more stitches, fasteners, adhesives, binders, or the like.

The shoe main body 552 can be made, in whole or in part, of natural materials (e.g., leather, natural rubber, cloth, or the like), plastics, polymers, metals, composites, combinations thereof, or other materials suitable for surrounding the user's foot. In some embodiments, the shoe main body 552 is made of pliable leather that conforms closely to a user's foot for enhanced comfort. In other embodiments, the shoe main body 552 is made of a generally rigid plastic that appreciably limits relative movement of the user's ankle and can therefore provide enhanced support to ensure that the user's body is properly positioned with respect to the exercise device 550.

Figure 17:
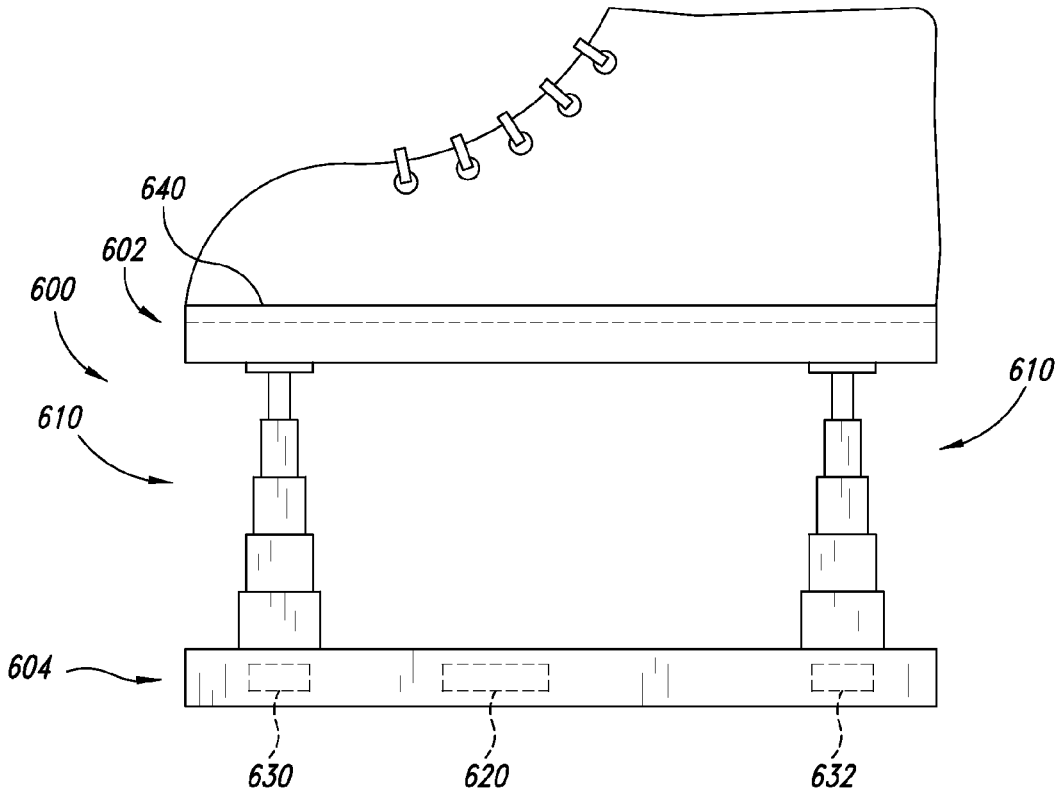
FIG. 17 is a side elevational view of an exercise device with telescoping mechanisms, in accordance with one embodiment.
Figure 18:
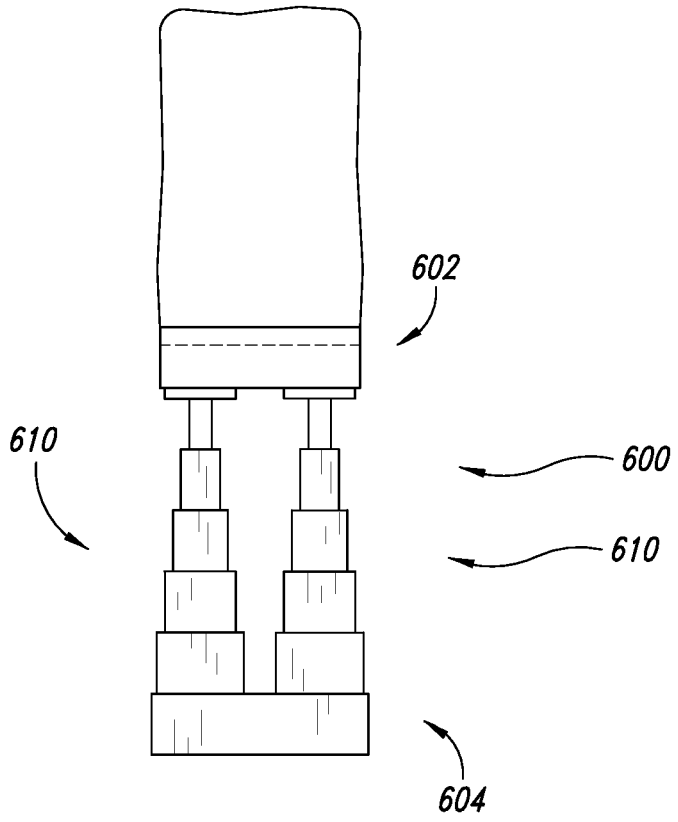
FIG. 18 is a rear view of the exercise device of FIG. 17.
Figure 19:
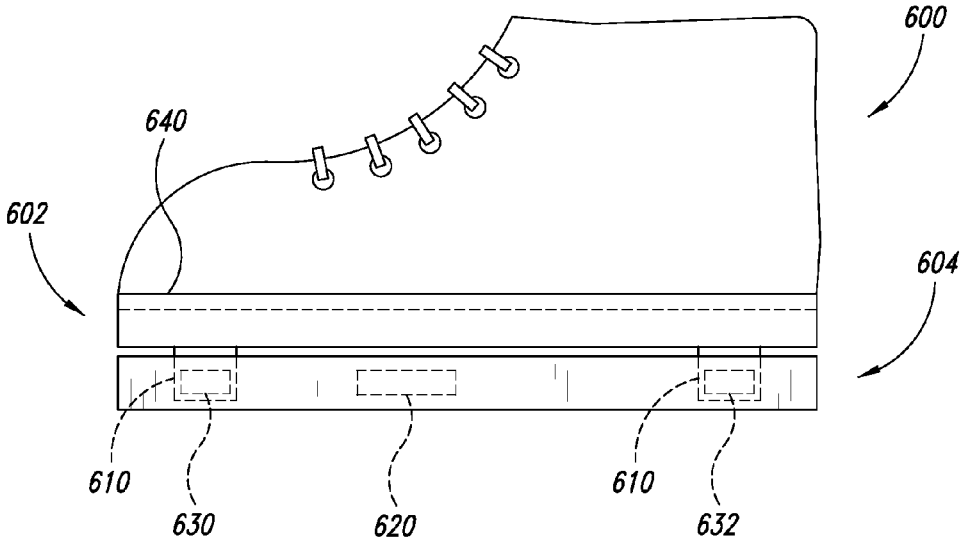
FIG. 19 is a side elevational view of the exercise device of FIG. 17 in a closed configuration.

FIGS. 17-19 illustrate an exercise device 600 that has an upper sole 602 translatable and/or rotatable with respect to a lower sole 604. A plurality of expandable mechanisms 610 can cooperate to move the upper sole 602 with respect to the lower sole 604. Each of the expandable mechanisms 610 is a telescoping mechanism. The expandable mechanisms 610 are capable of extending upwardly and contracting downwardly and are driven mechanically, pneumatically, hydraulically, or electro-mechanically. To lower a toe support region 640 of the upper sole 602, the front mechanisms 610 can be contracted while the rear mechanisms 610 remain generally stationary.

A controller 620 embedded in the lower sole 604 can be programmed remotely via a wireless network. The controller 620 is communicatively coupled to drive devices 630, 632 (see FIG. 19), which can move the mechanisms 610. The controller 620 can include a power source (e.g., one or more batteries) that powers the drive devices 630, 632.

Figure 20:
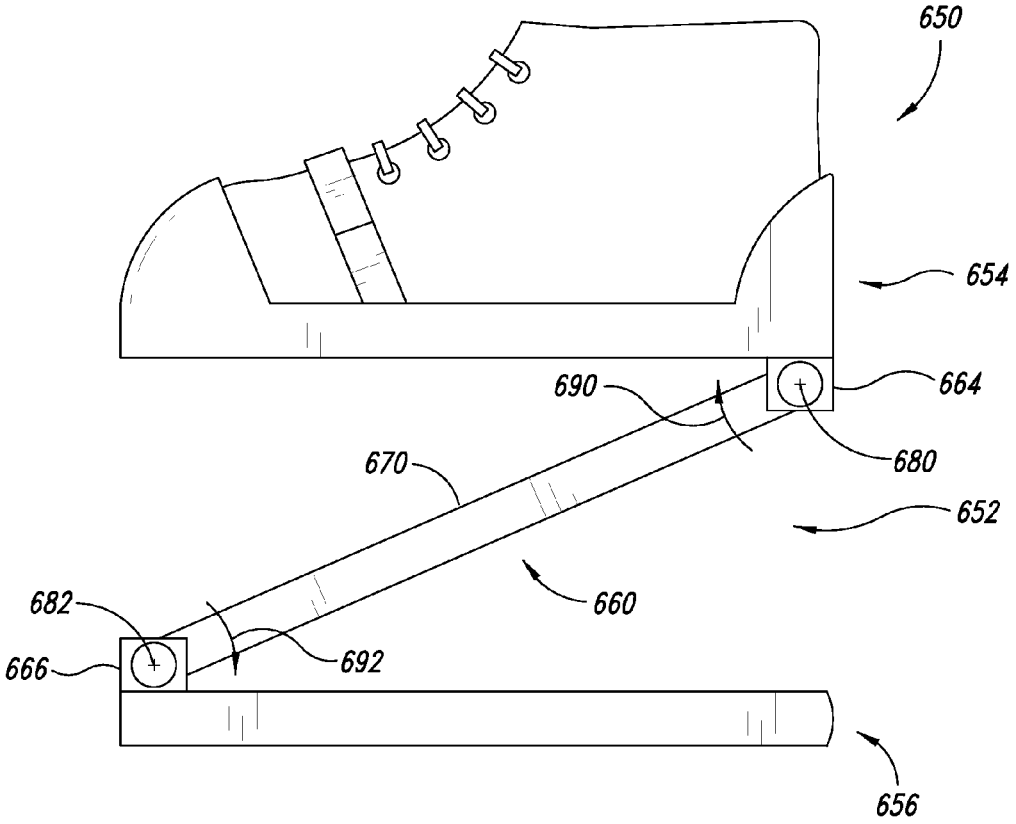
FIG. 20 is a side elevational view of an exercise device, in accordance with another embodiment. The exercise device is in an open configuration.
Figure 21:
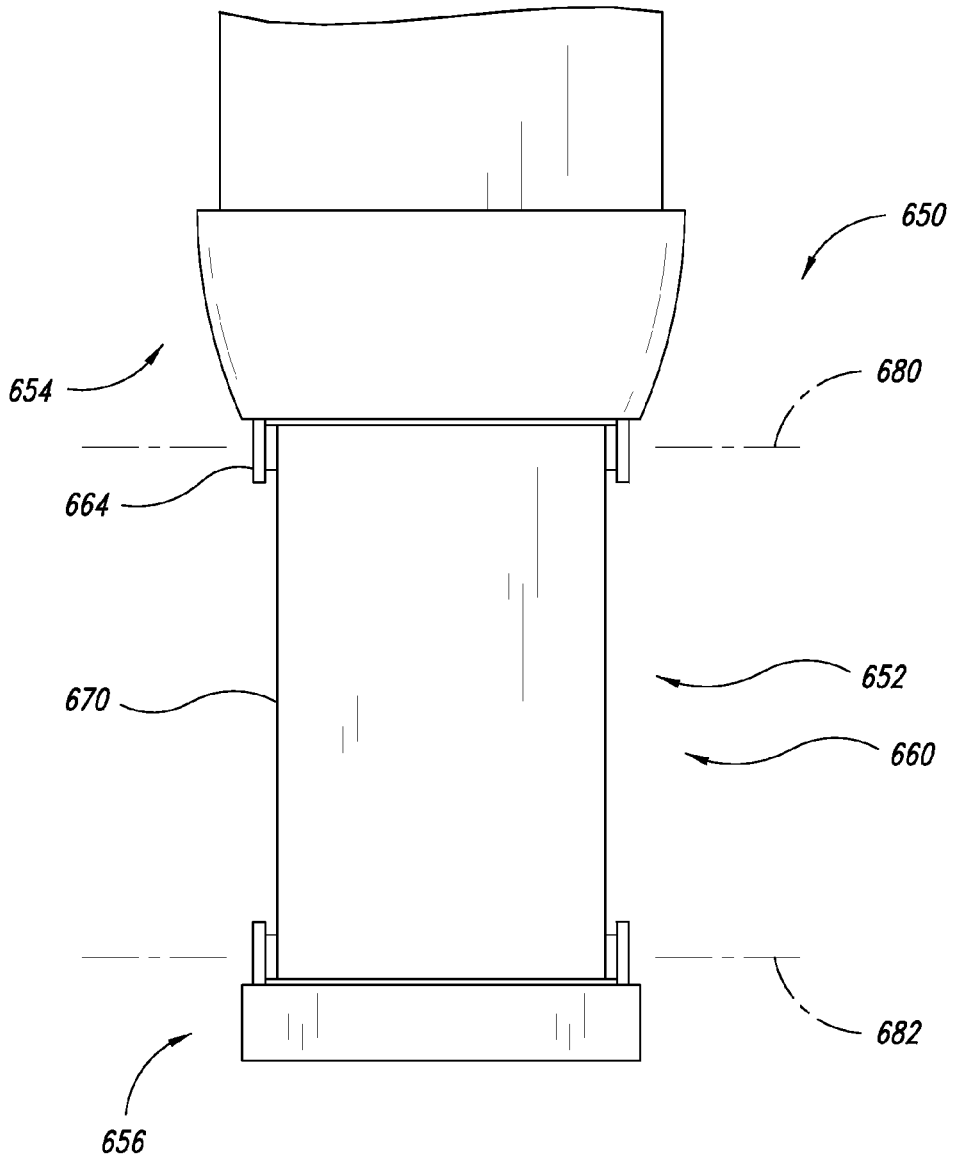
FIG. 21 is a rear view of the exercise device of FIG. 20.

FIGS. 20 and 21 show an exercise device 650 that has a generally Z-shaped configuration. A sole assembly 652 has an upper sole 654 connected to a lower sole 656 by an actuating mechanism 660. The actuating mechanism 660 includes a pair of pivoting mechanisms 664, 666 coupled to the upper sole 654 and the lower sole 656, respectively. The pivoting mechanisms 664, 666 can include, without limitation, one or more biasing members (e.g., helical springs, torsion rods, or the like) that allow a rigid elongate member 670 extending between the pivoting mechanisms 664, 666 to rotate about axes of rotation 680, 682.

Figure 22:
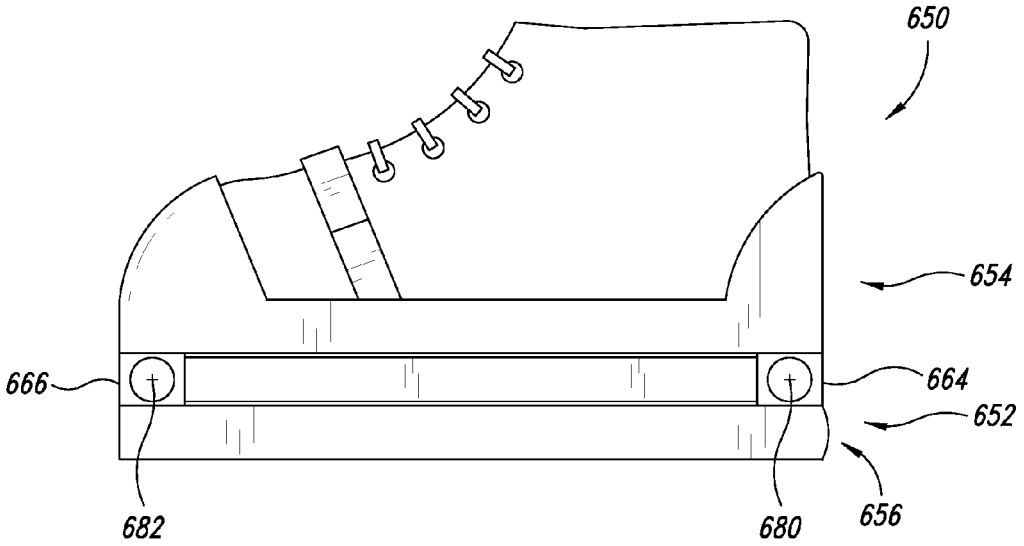
FIG. 22 is a side elevational view of the exercise device of FIG. 20 in a closed configuration.

FIG. 22 shows the exercise device 650 in the fully closed configuration. To close the exercise device 650, the elongate member 670 rotates about the axis of rotation 680, as indicated by the arrow 690 in FIG. 20. The elongate member 670 also rotates about the axis of rotation 682, as indicated by the arrow 692 in FIG. 20. During this process, the soles 654, 656 can remain generally parallel to each other to ensure that the user's foot remains generally horizontal.

Figure 23:
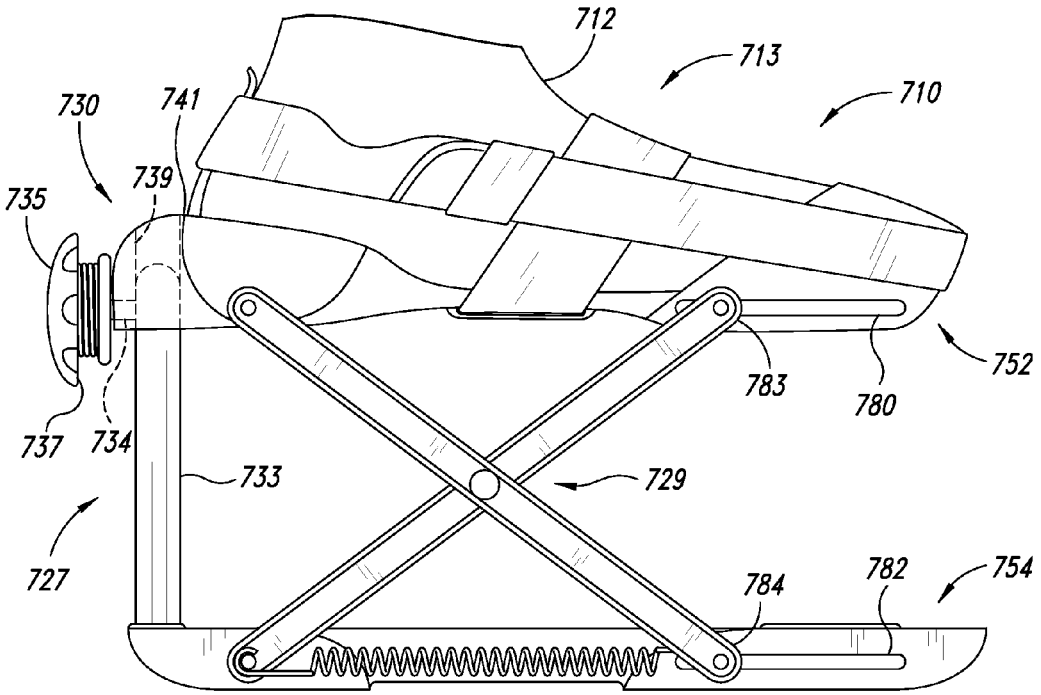
FIG. 23 is a side elevational view of an exercise device, in accordance with another embodiment.

Referring to FIG. 23, an exercise device 710 is coupled to a person's foot 712 via a foot restraint 713 and includes a selectively movable actuating mechanism 727. The actuating mechanism 727 includes a collapsible frame 729 and a control mechanism 730. The frame 729 includes elongate members that form scissor-type joints that allow relative movement between an upper sole 752 and a lower sole 754. The illustrated upper sole 752 and lower sole 754 include upper and lower outer elongated slots 780, 782, respectively. Free ends 783, 784 of the frame 729 slide along the slots 780, 782, respectively. The control mechanism 730 controls parameters (e.g., rate of collapse, rate of expansion, distance of travel, resistance to movement, maximum height, and the like). For example, the control mechanism 730 can adjust the rate of collapse when the user steps onto the exercise device 710.

The control mechanism 730 includes a rod 733 and an energy absorber in the form of a brake assembly 735. A pin 734 (shown in dashed line) of a rotatable handle 737 bears against the rod 733 slidably disposed in a through-hole 739 in a shoe main body 741. The pin 734 has external threads that mate with internal threads of a hole in the shoe main body 741 such that the end of the pin 734 moves towards or away from the rod 733 as the handle 737 rotates.

The rod 733 is fixedly coupled to the lower sole 754. The rod 733 extends upwardly away from the lower sole 754 and at least partially through the upper sole 752. When the exercise device 710 moves towards the closed configuration, the pin 734 frictionally slides along the rod 733. The frictional interaction provides the resistive force that controls the rate of collapse. To increase or decrease the resistive force, the compressive forces between the pin 734 and rod 733 can be increased or decreased.

Figure 24:
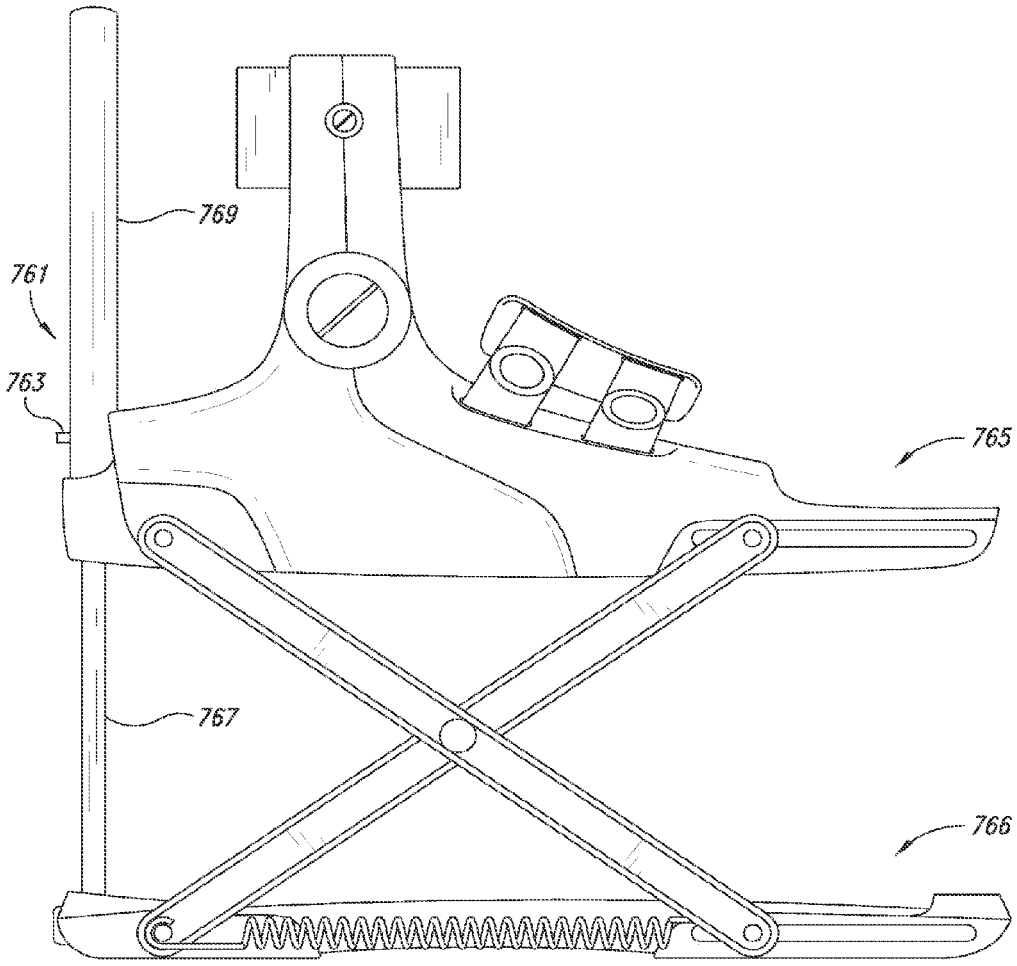
FIG. 24 is a side elevational view of an exercise device, in accordance with another embodiment.

Referring to FIG. 24, an energy absorber 761 can provide a selected distance of vertical travel. The energy absorber 761 includes a rod 767 that extends between a cylinder 769 and the lower sole 766. The cylinder 769 is fixedly coupled to an upper sole 765. The cylinder 769 slides downwardly and upwardly with respect to the rod 767. A positioning device 763 of the energy absorber 761 can be used to adjust a preset amount of travel between the upper sole 765 and the lower sole 766.

Figure 25A:
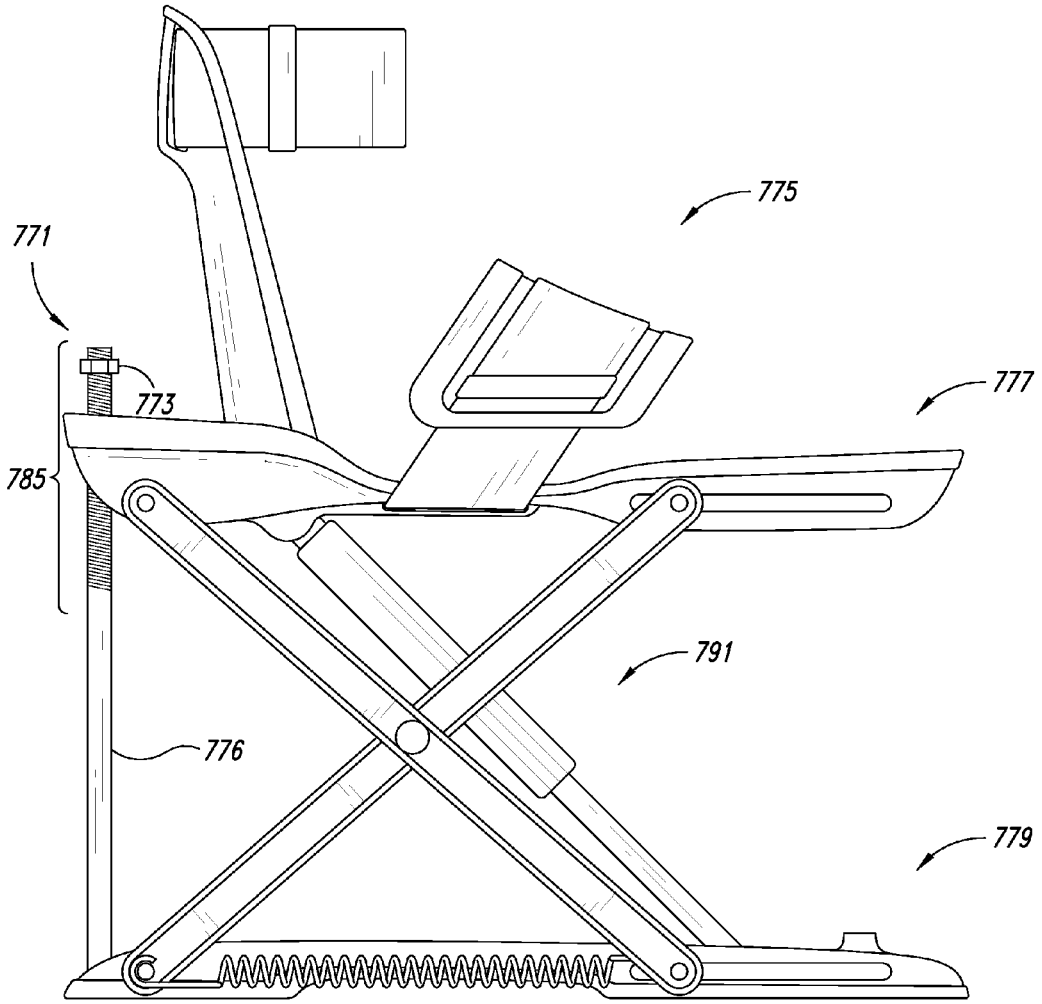
FIG. 25A is a side elevational view of an exercise device with a diagonally oriented energy absorber, in accordance with one embodiment.

FIG. 25A shows an exercise device 775 that includes an adjustment mechanism 771 with a stop 773 and a rod 776. The stop 773 can be moved along the rod 776 to control the travel of an upper sole 777. An engagement section 785 includes external threads that threadably engage internal threads of the stop 773. The stop 773 can be rotated to move it along the rod 776 towards or away from a lower sole 779 to decrease or increase the amount of travel of the upper sole 777, thereby adjusting the step-up height. An actuating mechanism 791 can raise the upper sole 777 until the upper sole 777 contacts the bottom of the stop 773.

In some embodiments, the stop 773 is in the form of a pin assembly, a clamp, or the like. If the stop 773 includes a pin assembly, the rod 776 can include an array of through holes for receiving a pin of the stop 773. The pin can be positioned in different holes of the rod 776. If the stop 773 includes a clamp, the clamp may be movable between an open configuration for sliding along the rod 776 and a closed configuration for fixedly coupling the stop 773 to the rod 776.

The adjustment mechanism 771 can change a maximum expansion distance of the exercise device 775. The maximum expansion distance can be the distance the upper sole 777 travels when the exercise device 775 moves from a collapsed configuration to an expanded configuration. In some embodiments, the external threaded section 785 of the rod 776 can have a longitudinal length of about 2 inches such that the adjustment mechanism 771 can change the maximum expansion distance about 2 inches. In other embodiments, the adjustment mechanism 771 can change the maximum expansion distance at least 3 inches, 4 inches, 5 inches, 6 inches, or ranges encompassing such lengths.

Figure 25B:
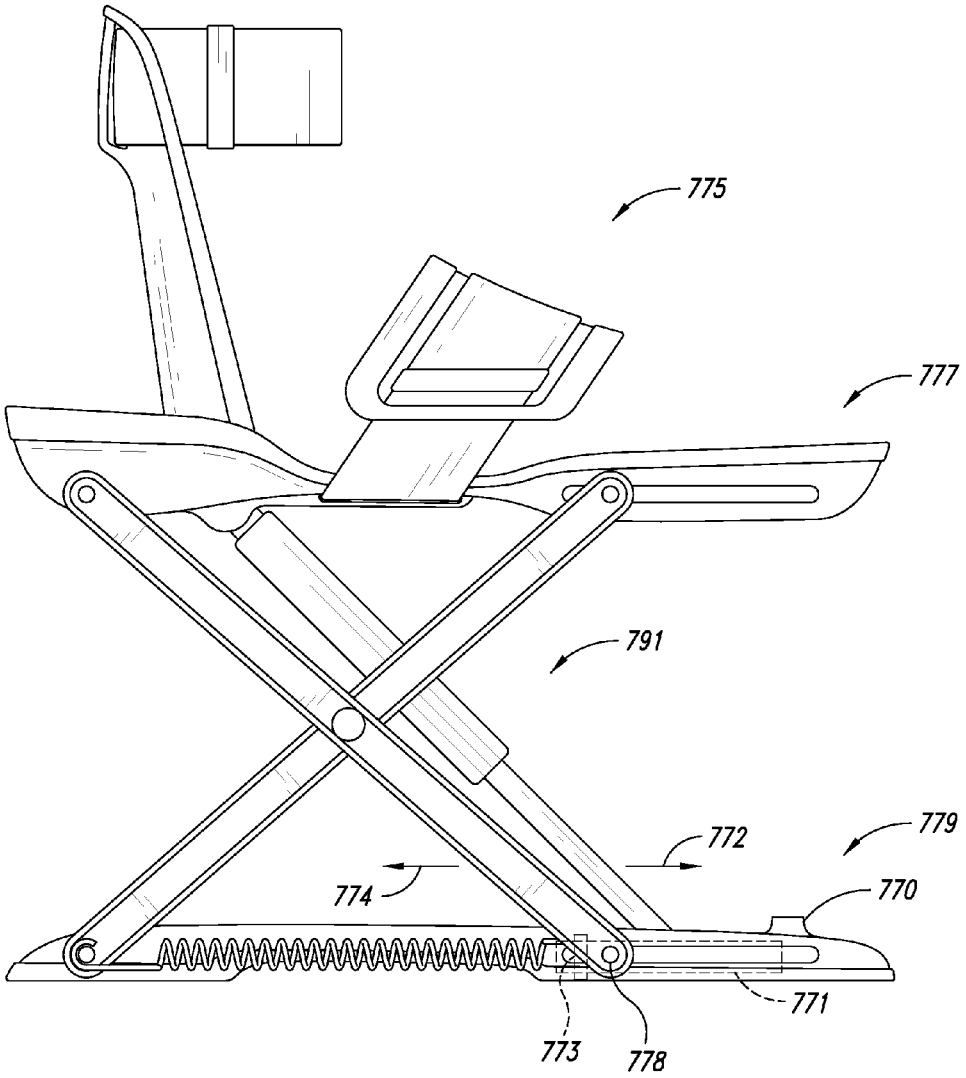
FIG. 25B is a side elevational view of an exercise device with a diagonally oriented energy absorber, in accordance with one embodiment.

Adjustment mechanisms can be at other locations and orientations. For example, FIG. 25B shows the adjustment mechanism 771 (illustrated in dashed line) extending from a roller assembly 778 to a mounting portion 770 of the lower sole 779. The stop 773 (illustrated in dashed line) can be moved forwardly (indicated by the arrow 772) or rearwardly (indicated by the arrow 774) to limit movement of the roller assembly 778 in order to decrease or increase the vertical travel of the upper sole 777.

Figure 26:
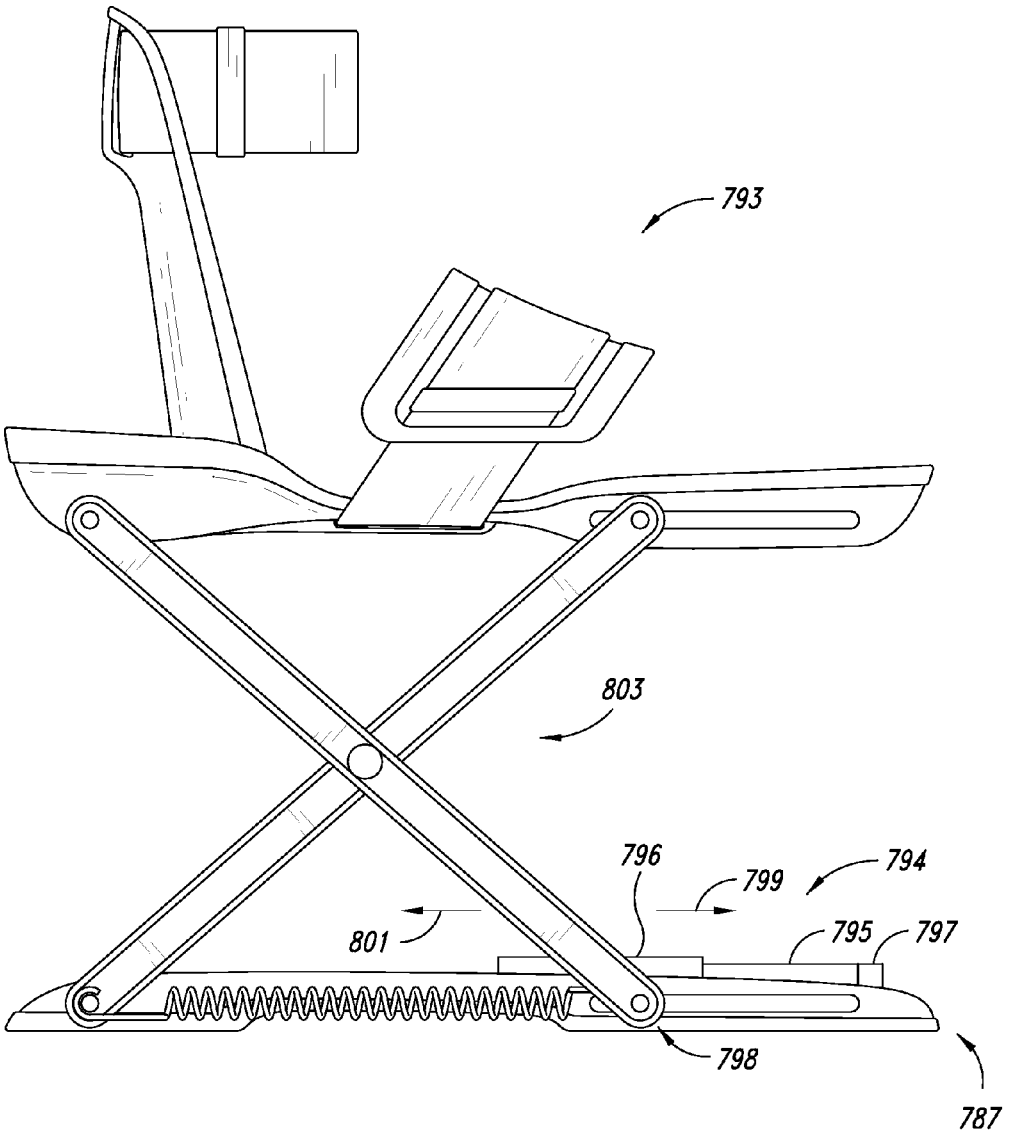
FIG. 26 is a side elevational view of an exercise device with a horizontally oriented energy absorber.

FIG. 26 shows an exercise device 793 with a generally horizontal energy absorber 794. The energy absorber 794 includes an extendable rod 795 extending between a cylinder 796 and a mounting portion 797 of a lower sole 787. The cylinder 796 is fixedly coupled to a roller assembly 798. The cylinder 796 slides forwardly (indicated by an arrow 799) and rearwardly (indicated by an arrow 801) with respect to the stationary rod 795. The energy absorber 794 is capable of determining a preset amount of travel between the roller assembly 798 and the lower sole 787.

Figure 27:
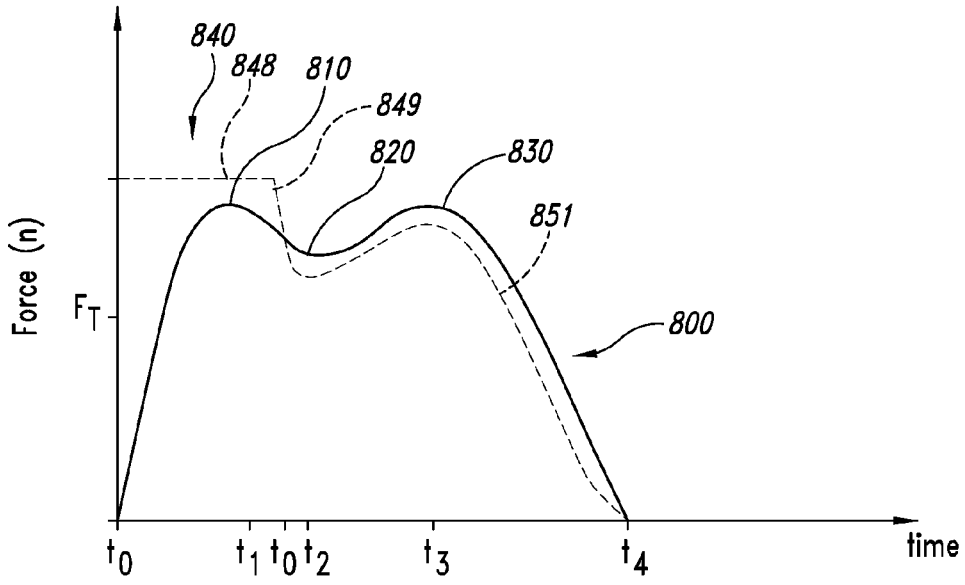
FIG. 27 is a graph of forces versus time.

FIG. 27 shows a curve 800 corresponding to a force applied to the ground when a user walks without wearing an exercise device. At $t_0$, the user's foot initially contacts the ground. The applied force increases to a local maximum 810 at $t_1$ as body weight is transferred to the user's heel. The applied force decreases to a local minimum 820 at $t_2$ as the body weight is transferred to the anterior portion of the foot. The applied force increases to another local maximum 830 at $t_3$ as the user pushes against the ground. The applied force decreases until the user's foot leaves the ground generally at $T_4$.

Figure 28:
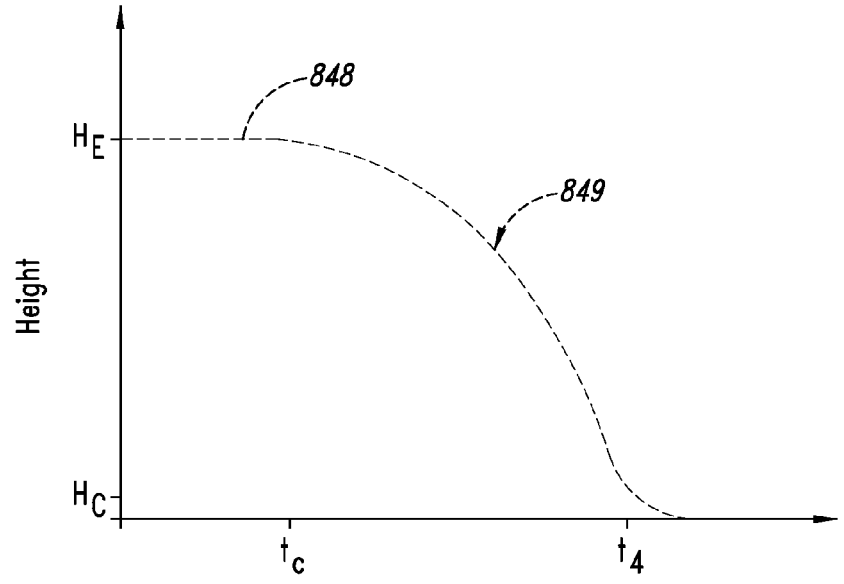
FIG. 28 is a graph of a height of an exercise device versus time.

A force curve 840 of FIG. 27 can be used to operate an exercise device to obtain a height curve 849 of FIG. 28. The force curve 840 can be the resistive force provided by an actuating mechanism. At a portion 848 of the curve 840, the expanded exercise device can remain at a constant height as the user begins to stand on the exercise device. The user can thus step up onto the exercise device before the exercise device has collapsed a significant distance. The portion 851 of the curve 840 corresponds to the user being lowered.

At $t_c$, the exercise device begins to collapse because the force 800 applied by the user is greater than the resistive force 840. The force required to initiate closing of the exercise device can be set by the user or may be determined by a controller. In some embodiments, $t_c$ can be equal to or greater than about 0.05 second, 0.1 second, 0.2 second, or 1 second. For example, $t_c$ can be in the range of about 0.1 second to about 0.5 second. Most or substantially all of the user's body mass can be supported by the exercise device as the exercise device begins to close. The percentage of the user's body mass supported by the exercise device that causes movement of the device can be selected based on the desired motion. In some embodiments, at least 95% of the user's body mass is supported by the exercise device before a distance between the lower sole and the upper sole is appreciably decreased. In some embodiments, at least 90%, 80%, or 50% of the user's body mass is supported by the exercise device before the exercise device is closed half way.

A portion of the curve 840 (e.g., the portion of the curve 840 between $t_2$ and $t_4$) can be offset from the curve 800 to provide a generally constant acceleration. The rate of collapse can thus increase as the user's foot approaches the ground. For example, height curve 849 in FIG. 28 gradually decreases after $t_c$ to provide a smooth motion.

Figure 29:
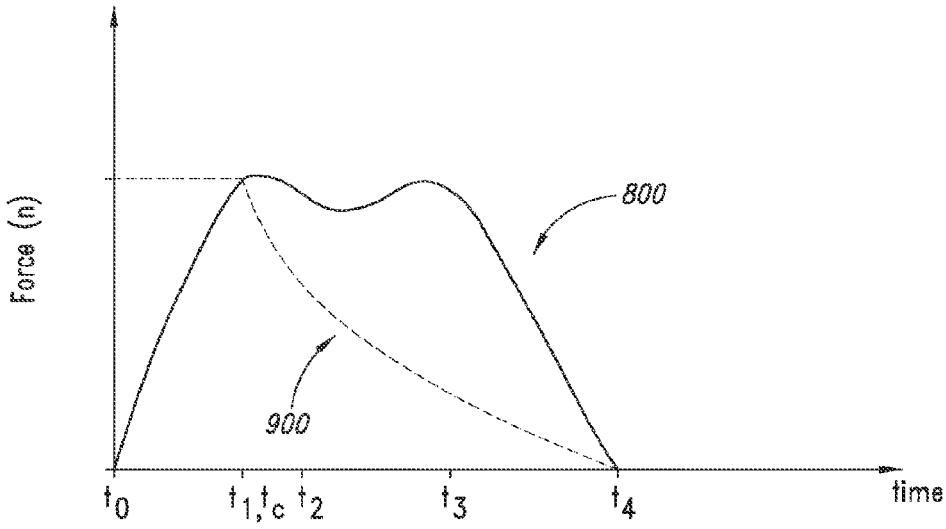
FIG. 29 is a graph of forces versus time.
Figure 30:
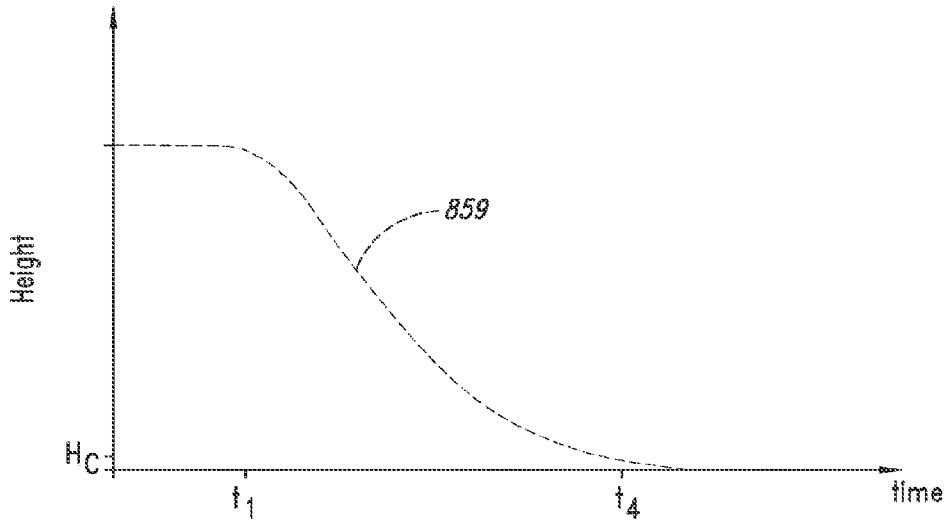
FIG. 30 is a graph of a height of an exercise device versus time.

FIG. 29 shows a force curve 900 used to operate an exercise device to obtain a height curve of FIG. 30. The curve 900 decreases after a significant amount of the user's body mass is supported by the exercise device. The curve 900 gradually decreases after the exercise device begins to close at $t_c$. $T_c$ can be less than, generally equal to, or greater than the $t_1$.

As shown by a curve 859 in FIG. 30, the height of the exercise device rapidly decreases after the user is supported by the exercise device. As the user's foot approaches the exercise device's end of travel, the rate of collapse gradually decreases to minimize, limit, or substantially eliminate impacted forces as the exercise device is fully closed.

To minimize, limit, or substantially prevent any appreciable sudden forces as the exercise device reaches the fully collapsed configuration, a cushioning member can be positioned between the upper and lower soles. The cushioning member can be made of foam or other highly compressible material. In some embodiments, cushioning members are coupled to an upper surface of the lower sole using adhesives.

Figure 31:
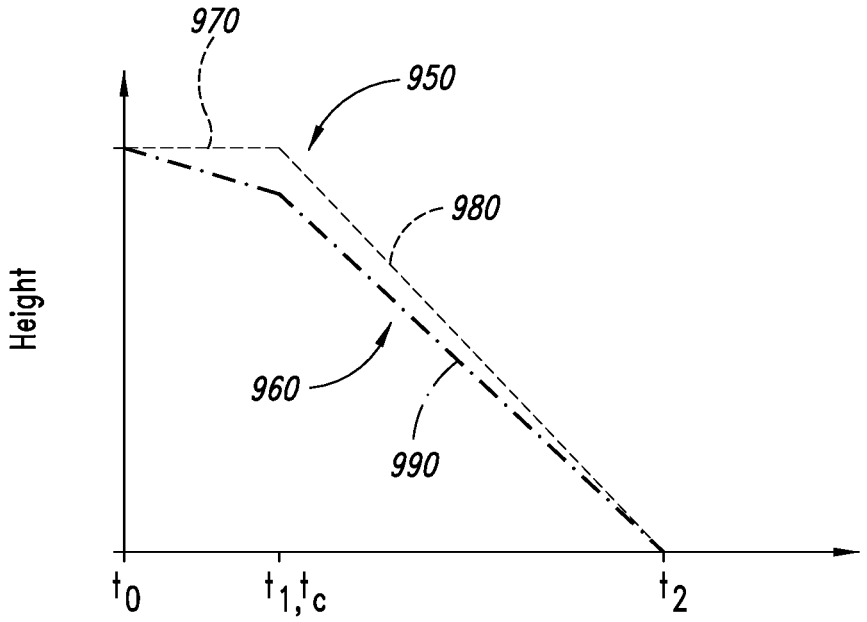
FIG. 31 is a graph of heights of exercise devices versus time.

FIG. 31 shows heights of two exercise devices versus time. The curves 950, 960 represent exercise devices that have a time delay mode of operation. The exercise devices remain in a generally expanded configuration from $t_0$ to $t_c$. In some embodiments, an exercise device includes a device that inhibits movement of an upper sole to substantially prevent any appreciable collapsing of the exercise device for a period of time after the exercise device is placed on a support surface and a desired force is applied to the exercise device. At $t_c$, the resistive force provided by the exercise device begins to decrease to allow the exercise device to close.

Figure 8:
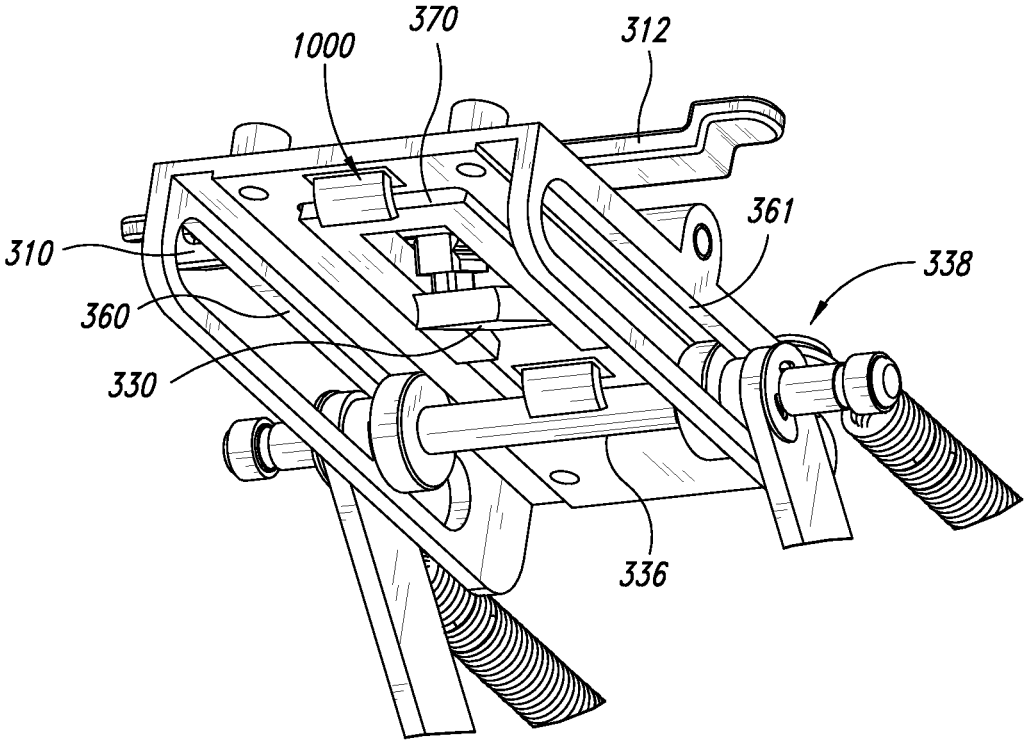
FIG. 8 is a front, bottom, and left side pictorial view of the adjustment mechanism of FIG. 7.

Different types of mechanisms can be used to obtain the height curves 950, 960 of FIG. 31. FIG. 8 shows a release mechanism 1000 that can keep the sole assembly 138 at the raised height for a desired length of time. The release mechanism 1000 can hold the shaft 336 to prevent the shaft 336 from moving rearward and thus delays collapsing of the sole assembly as the user initially steps onto the exercise device. To collapse the exercise device, the release mechanism 1000 rotates and/or translates to allow the shaft 336 to move in the rearward direction. The release mechanism 1000 can provide a time delay of at least 0.05 second, 0.1 second, 0.4 second, 0.5 second, 1 second, or 2 seconds. Of course, the length of the time delay can be selected based on the activity to be performed.

Referring again to FIG. 31, the curve 950 has a portion 970 corresponding to the exercise device in the expanded configuration. At a desired time $t_c$, the height of the exercise device linearly decreases from the time $t_c$ to $t_2$. As the exercise device closes at a generally constant rate of collapse from $t_1$ to $t_2$, the user can comfortably raise their other foot without losing their balance. The different slopes 980, 990 of the curves 950, 960 show that the exercise devices can collapse at different rates.

In operation, a user can step onto an exercise device without any noticeable collapsing of an exercise device to enhance the user's stability. For example, a user with a body mass of about 70 kg can step onto the exercise device without having the exercise device close more than about 10%. If the exercise device has a range of travel of about 8 inches, the exercise device closes less than about 0.8 inch. After most of the user's body mass is carried by the exercise device, the device moves to the closed configuration.

At $t_0$ to $t_c$, the curve 960 slightly decreases. As the user stands on the exercise device, the exercise device can close slightly to reduce or limit stresses applied to the user's joints. When the user's weight has been applied to the exercise device at $t_c$, the device can close at a higher rate of collapse.

A wide range of different types of energy absorbers can be used with the exercise devices disclosed herein. Energy absorbers can have integral delay mechanisms. Delay mechanisms can be mechanical devices, electro-mechanical devices, or the like. In some embodiments, the energy absorbers have different states of operation to provide different forces to control movement of the exercise devices.

Figure 32:
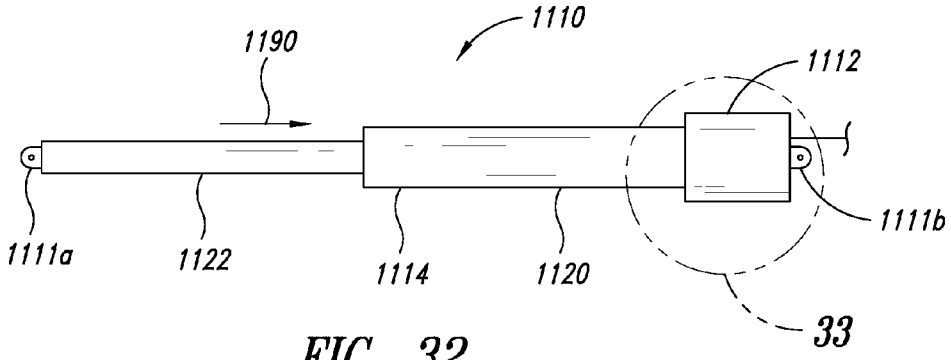
FIG. 32 is a side elevational view of an energy absorber, in accordance with one embodiment.

FIG. 32 shows an energy absorber 1110 that has multiple states of operation to control movement of an exercise device. The energy absorber 1110 includes mounts 1111*a*, 1111*b* for coupling to components of an exercise device, a piston assembly 1114, and a delay mechanism 1112 coupled to the piston assembly 1114. The piston assembly 1114 includes a rod 1122 and a main body 1120 that slidably receives the rod 1122.

Figure 33:
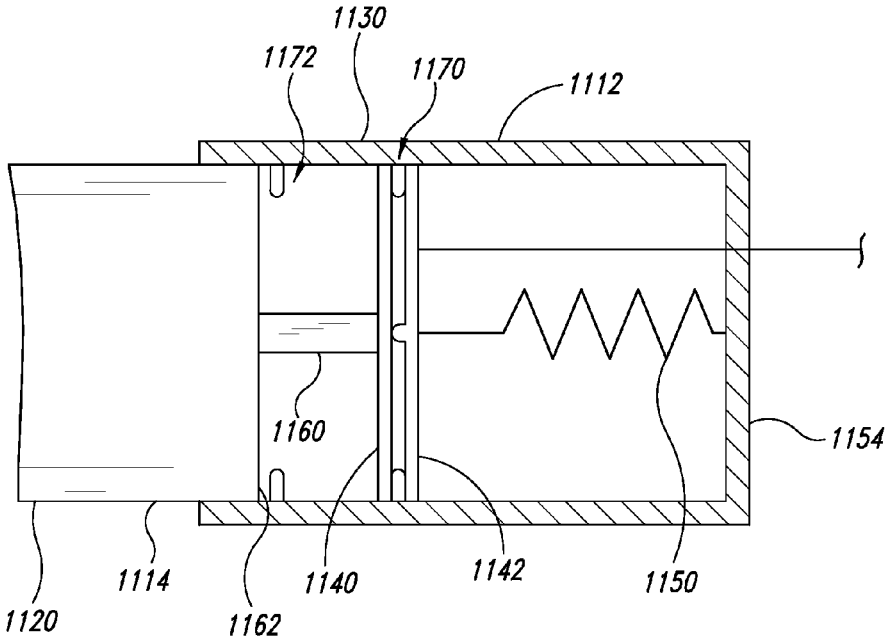
FIG. 33 is a detailed partial cross-sectional view of a portion of the energy absorber of FIG. 32.

Referring to FIG. 33, the delay mechanism 1112 includes an outer housing 1130 surrounding movable elements 1140, 1142 and a biasing member 1150 interposed between the element 1142 and a closed end 1154 of the housing 1130. A switch 1160 of the piston assembly 1114 extends outwardly from an end 1162 of the main body 1120. The piston assembly 1114 does not start to compress until the switch 1160 is mostly or entirely depressed. When the switch 1160 is in the extended position, the piston assembly 1114 can be in a locked state to keep the exercise device in an expanded configuration. The switch 1160 can be depressed to selectively unlock the piston assembly 1114.

The outer housing 1130 includes a positioning device 1170 for inhibiting movement of the element 1142 and a positioning device 1172 for inhibiting movement of the element 1140. The positioning devices 1170, 1172 can include, without limitation, latches, gates, movable pins, or other types of devices that can hold and release the elements 1142, 1140.

FIGS. 34-38 illustrate one method of operating the delay mechanism 1112. When the user applies a force to the exercise device, the positioning device 1170 can move to an open position, illustrated in dashed line in FIG. 34, to release the element 1142. The housing 1130 can include an actuator (e.g., a solenoid or other type of drive device) that moves the positioning device 1170 from a closed position in FIG. 33 to the open position in FIG. 34.

Figure 34:
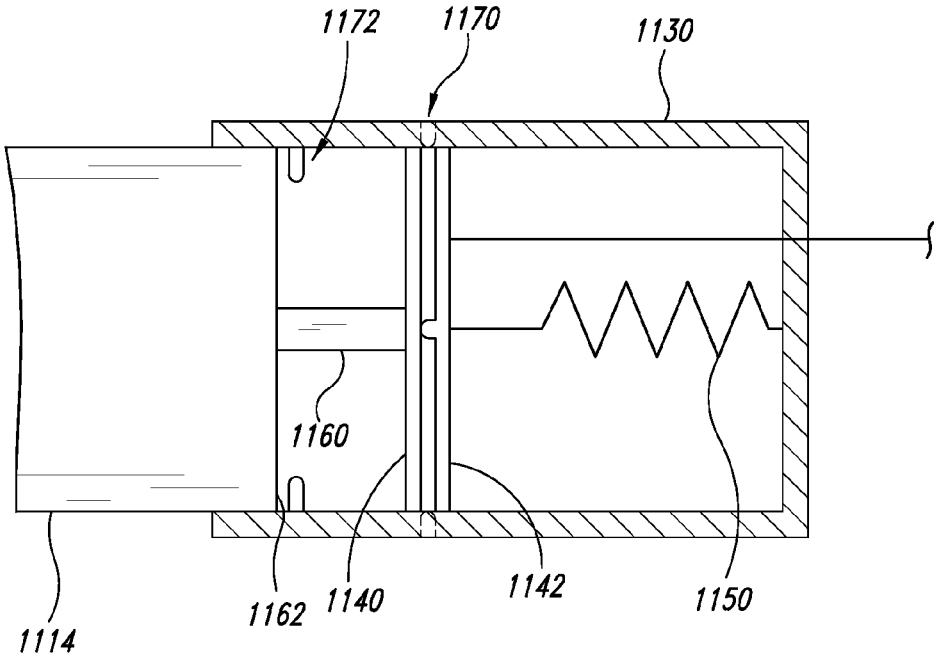
FIGS. 34-38 illustrate one method of operating the energy absorber of FIG. 31, in accordance with one embodiment.
Figure 35:
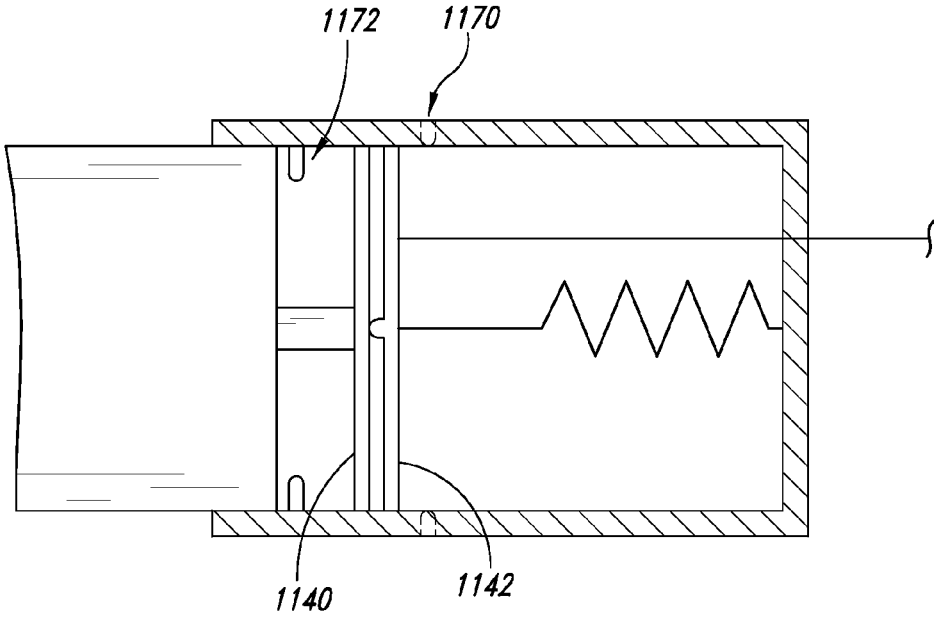

The biasing member 1150 of FIG. 34 pushes against the element 1142 to move the elements 1140, 1142 towards the end 1162 of the main body 1120. FIG. 35 shows the elements 1140, 1142 sliding along the housing 1130 to depress the switch 1160 The elements 1140, 1142 can be baffles (e.g., perforated baffles) that control the amount of time until the switch 1160 is depressed. For example, the housing 1130 can contain a fluid (e.g., a hydraulic fluid) that flows past the elements 1140, 1142. In some embodiments, fluid is interposed between the elements 1140, 1142. The element 1142 compresses the fluid, which gradually flows past the element 1142 to allow the element to contact the element 1140. A wide range of different types of elements (e.g., sealing members, baffles, valves, pliable members, or the like) can be positioned inside of the housing 1130 to increase or decrease the time it takes to move the element 1142 from a first position of FIG. 34 to a second position of FIG. 36. In some embodiments, the delay mechanism 1112 includes one or more pliable members (e.g., foam-filled members with one or more air valves), flow restrictors, flow regulators, or the like. These components can cooperate to control movement of the piston assembly 1114.

The positioning devices 1170, 1172 can be generally similar to each other and, accordingly, the description of one of the positioning devices applies equally to the other, unless indicated otherwise. The positioning devices 1170, 1172 may include pins that move inwardly and outwardly with respect to the housing 1130. In some embodiments, the positioning device 1172 is in the form of a hinged element that swings inwardly and outwardly in response to forces applied to the element 1140. For example, the hinged element can move to a closed position (e.g., when the hinged element extends generally perpendicularly to a longitudinal axis of the housing 1130) to hold the switch 1160 in a depressed position. The element can swing towards a sidewall of the housing 1130 to allow the switch 1160 to return to the extended position.

Figure 36:
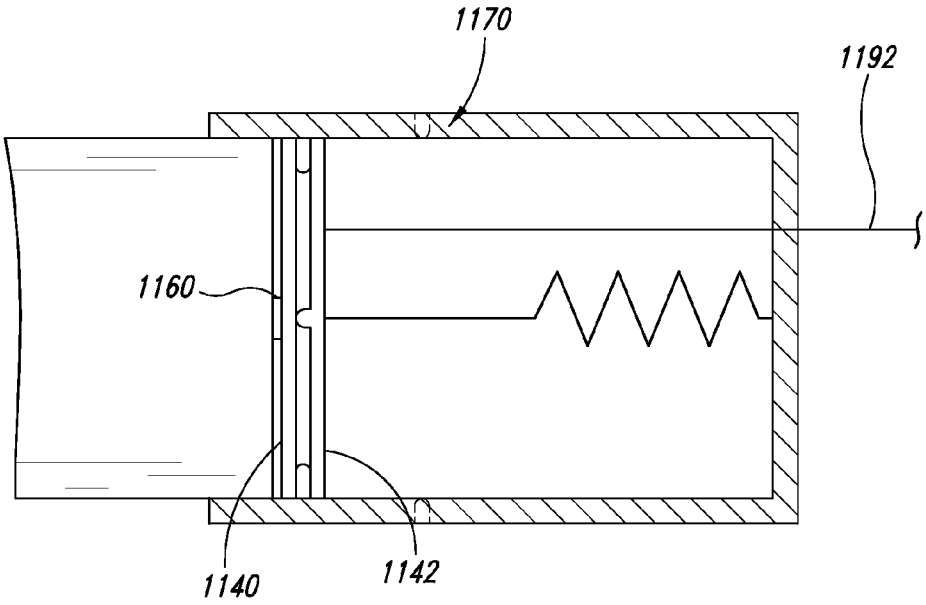
Figure 37:
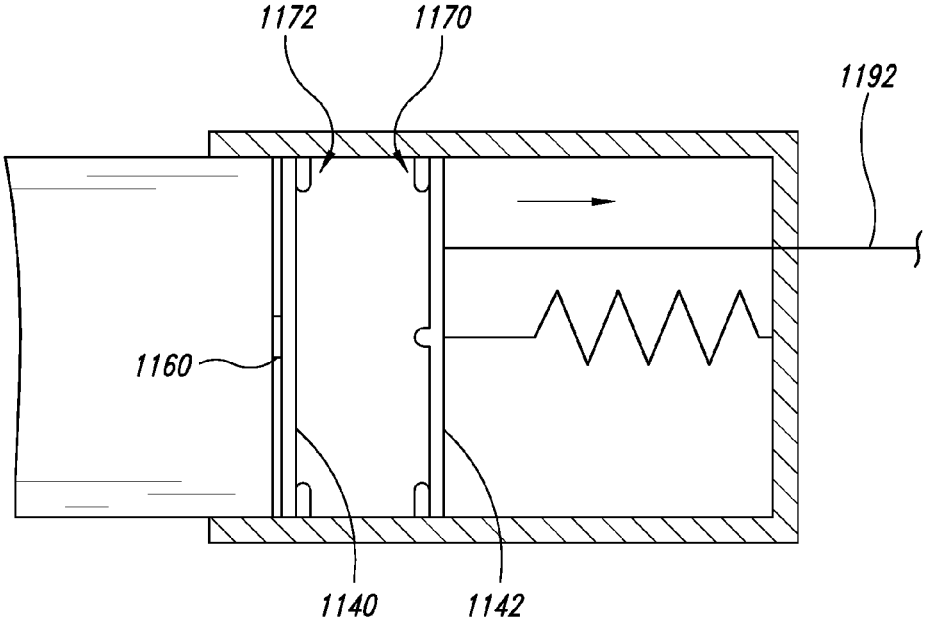

Referring to FIG. 36, the element 1140 holds the switch 1160 in a depressed position to allow the piston assembly 1114 to begin to collapse. The rod 1122 slides into the main body 1120 (indicated by an arrow 1190 of FIG. 32) to allow the exercise device to move towards the collapsed configuration. In some embodiments, the piston assembly 1114 is configured to gradually allow the exercise device to collapse. In other embodiments, the piston assembly 1114 is configured to provide substantially no resistive force such that the exercise device falls freely towards the collapsed configuration.

The piston assembly 1114 can provide a wide range of different resistance profiles. In some embodiments, the resistance profiles vary during compression. For example, the piston assembly 1114 can provide forces that can increase significantly as the piston assembly 1114 reaches a fully compressed position. As the exercise device reaches its compressed position, the piston assembly 1114 can rapidly reduce the rate of collapse of the exercise device. In some embodiments, the piston assembly 1114 may be adjustable to provide various desired resistances, or resistance profiles.

As the exercise device moves towards the collapsed configuration, the element 1142 can return to its first position. A line 1192 is capable of pulling the element 1142 shown in FIG. 36 to the initial position shown in FIG. 37. The line 1192 can be coupled to a component of the upper sole of an exercise device, or another component movable with respect to the delay mechanism 1112, to automatically pull the element 1142 to the first position.

Figure 38:
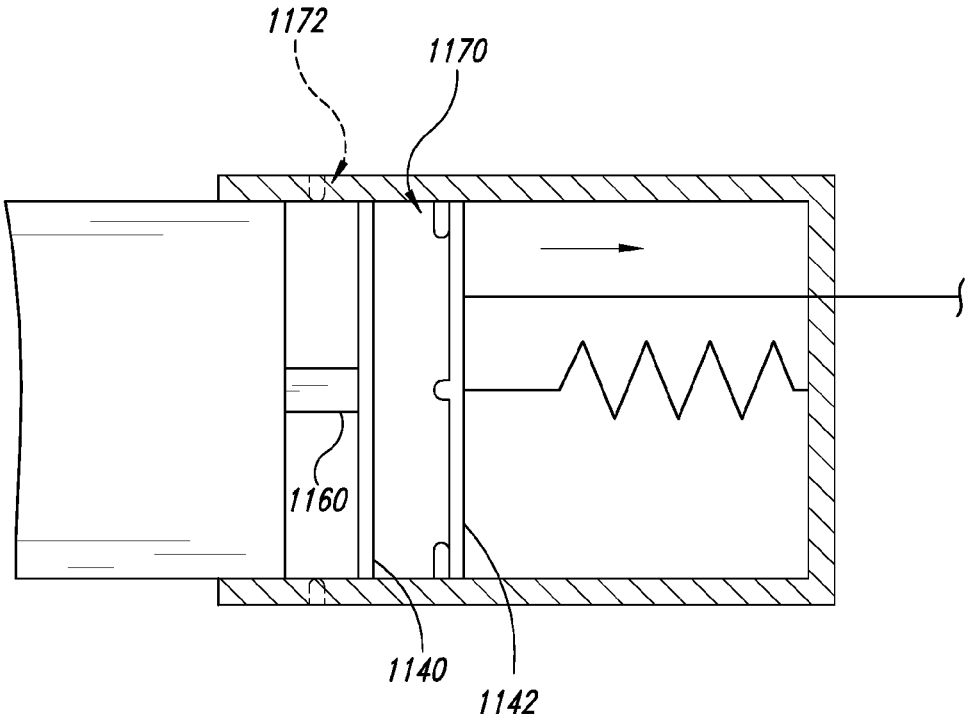

After the exercise device has collapsed, the user can pick up the exercise device to allow self-expansion. Once the exercise device has reached the desired step-up height, the positioning device 1172 can release the element 1140 of FIG. 37 to allow the switch 1160 to return to its initial position (i.e., the extended position) to lock the piston assembly 1114. The switch 1160 can push the element 1140 towards the element 1142, as shown in FIG. 38. In some embodiments, a controller is used to operate the positioning device 1170 based on signals generated by one or more sensors that detect the height of the exercise device.

The energy absorber 1110 of FIGS. 32-38 can include other types of delay mechanisms. In some embodiments, the delay mechanism 1112 includes a drive device (e.g., a solenoid) capable of selectively depressing the switch 1160 of the piston assembly 1114. The solenoid can be selectively activated and deactivated by supplying power to the solenoid and stopping the supply of power to the solenoid, respectively. The solenoid can be activated to depress the switch 1160 to allow the piston assembly 1114 to compress. The solenoid can be deactivated to return the switch 1160 to its extended position to lock the piston assembly 1114. In some modes of operation, for example, the piston assembly 1114 is in a locked configuration to allow the user to step onto the exercise device. The solenoid is activated to collapse the exercise device. The exercise device can expand a desired amount before the solenoid is deactivated to lock the piston assembly 1114.

Figure 39:
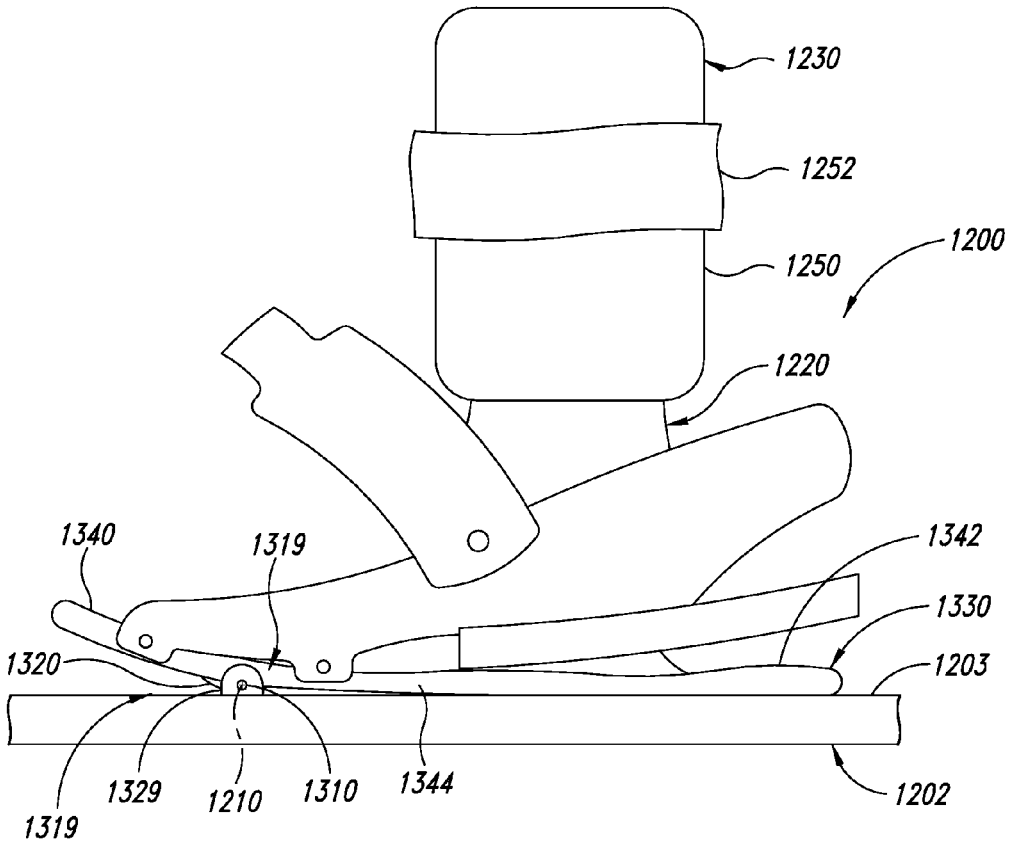
FIG. 39 is a right side elevational view of a foot retainer coupled to an upper sole.
Figure 40:
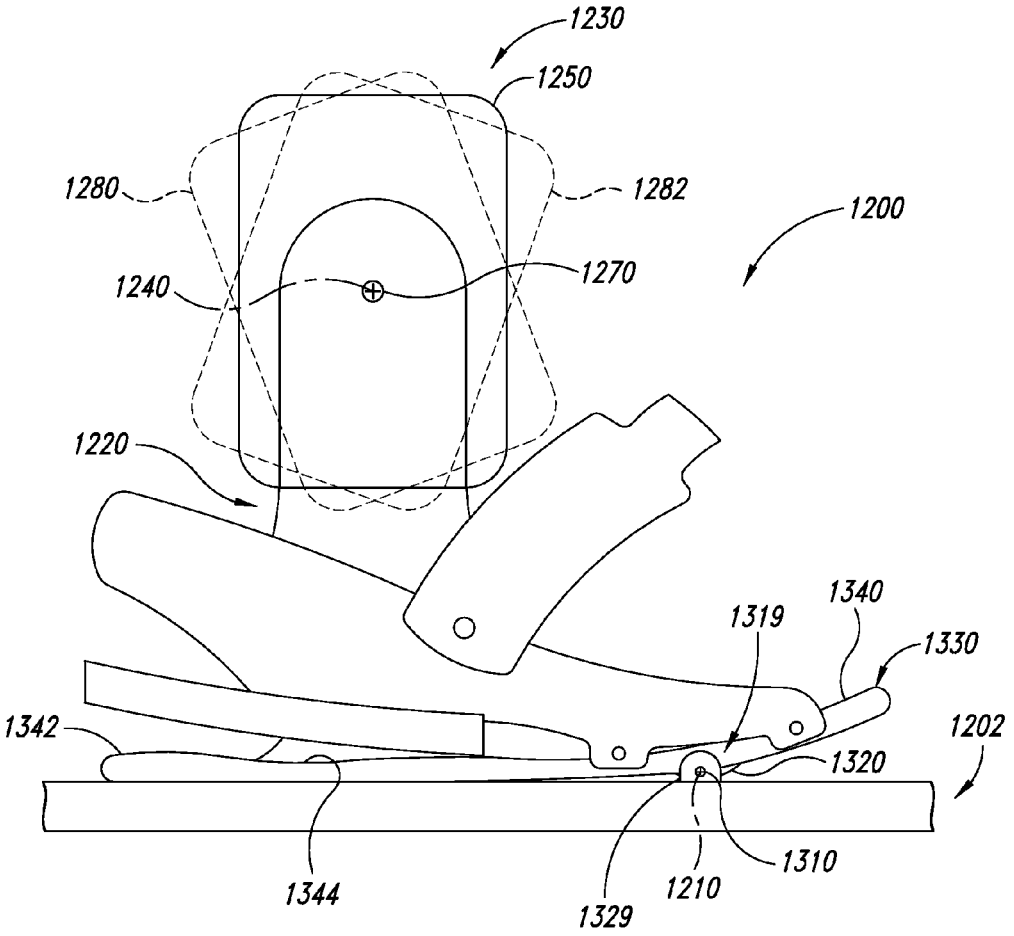
FIG. 40 is a left side elevational view of the foot retainer of FIG. 39.

FIGS. 39 and 40 illustrate a foot retainer 1200 pivotably coupled to an upper sole 1202. The foot retainer 1200 and upper sole 1202 can cooperate to provide a natural heel to toe motion. A user can comfortably transfer weight to the ball of the user's foot by rotating the foot retainer 1200 about an axis of rotation 1210.

The foot retainer 1200 includes a brace 1220 and a leg holder 1230 rotatably coupled to the brace 1220. An axis of rotation 1240 is defined by a pivot pin 1270 coupling the leg holder 1230 to the brace 1220. The brace 1220 and the leg holder 1230 cooperate to support the user's leg while allowing relative movement between the user's lower leg and the user's foot.

The leg holder 1230 includes a main body 1250 configured to accommodate at least a portion of a user's leg and a retainer 1252 (illustrated in the form of a strap) configured to surround and hold the user's leg against the main body 1250. When the user places an exercise device on the ground, the main body 1250 can be in a first position 1280 (shown in dashed line in FIG. 40). The main body 1250 rotates (e.g., at least 10 degrees, 20 degrees, 40 degrees, 60 degrees, or the like) from the first position 1280 to a second position 1282 (shown in dashed line) to allow the user to comfortably step off of the ground. In this manner, the leg holder 1230 promotes a natural walking motion while the brace 1220 reinforces the user's ankle to protect against sprains or unwanted twisting.

The brace 1220 can be an ankle support brace extending upwardly alongside a user's ankle such that the axis of rotation 1240 is generally at a location where the user's foot bends when the user walks. For example, the axis of rotation 1240 is generally aligned with the user's ankle. The brace 1220 can be made, in whole or in part, of a rigid material, such as one or more metals, composites, plastics, or the like. In some embodiments, the brace 1220 is a metal brace made of aluminum or steel.

The foot retainer 1200 can further include a foot plate 1330 pivotally coupled to the upper sole 1202. The foot plate 1330 includes a toe support region 1340, a heel support region 1342, and a main body 1344 extending between the toe support region 1340 and the heel support region 1342. An axis of rotation 1210 can be positioned generally below the ball of the user's foot during use. The foot plate 1330 can therefore rotate as the user transfers weight from the heel to the ball of the foot. In other embodiments, the axis of rotation 1210 can be positioned anterior or posterior to the ball of the user's foot. For example, the axis of rotation 1210 can be positioned below the arch of the user's foot. The axis of rotation 1210 can also be at other locations, if need or desired.

A pin 1310 extends through a mount 1320 of the foot plate 1330 and a mount 1329 of the upper sole 1202 to define the axis of rotation 1210. The mounts 1320, 1329 and pin 1310 form a pivoting mechanism 1319. When the user steps onto the exercise apparatus, the heel support region 1342 can be pressed against an upper surface 1203 of the upper sole 1202. As the user transfers weight to the front of the foot, the foot plate 1330 rotates about the axis of rotation 1210 to bring the toe support region 1340 into contact with the upper surface 1203.

It should be noted that, as used in this specification and the appended claims, the singular forms "a," "an," and "the" include plural referents unless the context clearly dictates otherwise. It should also be noted that the term "or" is generally employed in its sense including "and/or" unless the content clearly dictates otherwise.

Various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

The exercise apparatus disclosed herein can be worn to provide a workout that is appreciably similar to the workout provided by climbing stairs or using a stair master machine. For example, a user can wear the apparatus indoors while performing everyday chores and activities. In outdoor applications, the user can wear the device on generally flat surfaces that can be found at shopping centers, malls, parks, sidewalks, or the like. The apparatuses can provide a motion that generally simulates climbing stairs to provide a vigorous workout even though the user is traveling across these generally flat surfaces. Of course, the apparatuses can be worn while traveling along uneven surfaces (e.g., while hiking) and on relatively steep inclines or declines. Traveling is broadly construed to include, without limitation, walking, running, jogging, or the like. In some embodiments, the exercise apparatuses can be used in aerobic classes. For example, a user can lock one exercise device in an extended configuration and the other exercise device in a collapsed configuration to perform step-up routines. The user can then step in place.

Furthermore, the skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. An exercise footwear apparatus, comprising:

a self-expanding sole assembly movable between an expanded configuration and a compressed configuration, the sole assembly comprising:

a lower sole portion;

an upper sole portion movable with respect to the lower sole portion; and an expansion mechanism configured to allow the self-expanding sole assembly to begin to collapse an appreciable amount after a user steps onto the self-expanding sole assembly and after a substantial portion of the user's weight is supported by the sole assembly, and the expansion mechanism is configured to expand the sole assembly after removal of the substantial portion of the user's weight, wherein the expansion mechanism does not provide an appreciable propelling force as the user steps off a support surface, and wherein the expansion mechanism is configured to provide a resistive force that controls collapse of the sole assembly; and wherein a magnitude of the propelling force, if any, is less than about 50% of a maximum magnitude of the resistive force.

2. The exercise footwear apparatus of claim 1, wherein the expansion mechanism includes a delay mechanism configured to delay collapse of the sole assembly until the substantial portion of the user's weight is supported by the sole assembly.

3. The exercise footwear apparatus of claim 1, wherein the expansion mechanism has a first state of operation to provide a first rate of collapse and a second state of operation to provide a second rate of collapse after the sole assembly has partially collapsed at the first rate of collapse, the second rate of collapse is substantially greater than the first rate of collapse.

4. The exercise footwear apparatus of claim 1, wherein the expansion mechanism has a first state of operation to provide a first resistive force and a second state of operation to provide a second resistive force, the first resistive force is different from the second resistive force.

5. The exercise footwear apparatus of claim 1, further comprising:

a sensor; and a controller communicatively coupled to the sensor, the controller commands the expansion mechanism based on at least one signal from the sensor so as to delay collapse of the sole assembly at least until the substantial portion of the user's weight is supported by the sole assembly.

6. The exercise footwear apparatus of claim 1, further comprising a controller configured to command the expansion mechanism to substantially prevent any appreciable collapsing of the sole assembly for a period of time.

7. The exercise footwear apparatus of claim 1, wherein the exercise footwear apparatus has a locked state to keep the self-expanding sole assembly in the compressed configuration.

8. An exercise device comprising a sole assembly configured to support a user, the sole assembly including a lower sole portion;

an upper sole portion; and a self-expanding actuating mechanism configured to prevent the sole assembly from collapsing an appreciable amount until a substantial portion of the user's weight is supported by the sole assembly, wherein the sole assembly has a first state of operation to provide a first rate of collapse and a second state of operation to provide a second rate of collapse after the actuating mechanism has partially collapsed at the first rate of collapse, the second rate of collapse is substantially greater than the first rate of collapse, and wherein the actuating mechanism includes at least one elongated member pivotally coupled to the upper sole portion and the lower sole portion.

9. The exercise device of claim 8, further comprising:

a sensor; and a controller communicatively coupled to the sensor, the controller determines the first rate of collapse and the second rate of collapse based on at least one signal from the sensor.

10. The exercise device of claim 9, wherein the actuating mechanism in the first state of operation inhibits movement of the sole assembly to substantially prevent any appreciable collapse of the sole assembly as the user applies pressure to the sole assembly.

11. The exercise device of claim 9, wherein the actuating mechanism in the first state of operation inhibits movement of the sole assembly to substantially prevent any appreciable collapse of the sole assembly as the user applies pressure to the sole assembly and the second state of operation is a non-resistive state of operation for allowing the sole assembly to fall freely towards a collapsed configuration.

12. An exercise system, comprising:

a pair of step-up apparatuses wearable on feet of a user, each step-up apparatus configurable between an expanded configuration and a compressed configuration to simulate a selected motion when the user wearing the pair of step-up apparatuses travels by foot, at least one of the step-up apparatuses including a sensor, a controller communicatively coupled to the sensor, the controller being configured to command the at least one step-up apparatus to keep the at least one step-up apparatus from collapsing an appreciable amount until most of the user's weight is supported by the at least one step-up apparatus, the controller is programmed to begin to collapse the at least one step-up apparatus based on at least one signal from the sensor, and an expansion mechanism configured to allow the step-up apparatus to begin to compress an appreciable amount after a user steps onto the step-up apparatus, wherein the expansion mechanism is configured to expand the step-up apparatus after removal of a substantial portion of the user's weight, and wherein the expansion mechanism does not provide an appreciable propelling force as the user steps off a support surface and is configured to provide a maximum resistive force that controls collapse of the step-up apparatus; and wherein a magnitude of the propelling force, if any, is less than about 50% of a maximum magnitude of the resistive force.

13. The exercise system of claim 12, wherein the controller is configured to determine different rates of collapse based on at least one signal from the sensor.

14. The exercise system of claim 12, wherein the controller commands the at least one step-up apparatus to allow the step-up apparatus to collapse based on a time delay.

15. The exercise system of claim 12, wherein the controller is configured to command the at least one step-up apparatus based on at least one signal from the sensor so as to delay collapse of the at least one step-up apparatus at least until a substantial portion of the user's weight is supported by the at least one step-up apparatus.

16. The exercise system of claim 12, wherein the controller has stored executable programs for controlling exercise intensity, targeting desired muscles, or providing a desired simulated movement.

17. The exercise footwear apparatus of claim 1, wherein the upper sole portion is rotatable relative to the lower sole portion.

18. The exercise footwear apparatus of claim 1, wherein the sole assembly includes an energy absorber.

19. The exercise footwear apparatus of claim 1, wherein the self-expanding sole assembly is configured to support at least 50% of the user's body mass before the self-expanding sole assembly is closed half-way.

20. The exercise footwear apparatus of claim 1, wherein the self-expanding sole assembly is configured to support at least 95% of the user's body mass before the self-expanding sole assembly is closed half-way.

21. The exercise footwear apparatus of claim 1, wherein the sole assembly in an open configuration is configured to support most of the user's weight without having the sole assembly close more than 10%.

22. The exercise footwear apparatus of claim 1, wherein the expansion mechanism is configured to delay collapse of the sole assembly for at least about 0.05 second during use.

23. The exercise footwear apparatus of claim 1, wherein the expansion mechanism comprises an energy absorber configured to control collapse of the self-expanding sole assembly and one or more biasing members for opening the self-expanding sole assembly.

24. An exercise footwear apparatus, comprising:

a sole assembly comprising:

a lower sole portion;

an upper sole portion movable towards the lower sole portion to move the sole assembly from an expanded configuration to a compressed configuration; and a mechanism configured to prevent an appreciable amount of collapse of the sole assembly until after a substantial portion of a user's weight is supported by the sole assembly, and the mechanism is configured to expand the sole assembly after removal of the substantial portion of the user's weight, wherein the mechanism does not provide an appreciable propelling force as the user steps off a support surface and is configured to provide a maximum resistive force that controls collapse of the sole assembly, and wherein a magnitude of the propelling force, if any, is less than about 50% of a maximum magnitude of the resistive force.

25. The exercise footwear apparatus of claim 24, wherein the sole assembly supports at least 50% of the user's body mass before the sole assembly closes half-way.

26. The exercise footwear apparatus of claim 24, wherein the mechanism is configured such that the sole assembly supports at least 95% of the user's body mass before the sole assembly closes half-way.

27. The exercise footwear apparatus of claim 24, wherein the sole assembly is configured to support most of the user's mass without the sole assembly closing more than 10%.

28. The exercise footwear apparatus of claim 24, wherein the mechanism is configured to delay significant collapse of the sole assembly for at least about 0.05 second after the user begins to step onto the sole assembly.

29. The exercise footwear apparatus of claim 24, wherein the mechanism includes an expansion mechanism and an energy absorber.

* * * * *

UNITED STATES PATENT AND TRADEMARK OFFICE

CERTIFICATE OF CORRECTION

PATENT NO. : 8,617,033 B2
APPLICATION NO. : 12/865695
DATED : December 31, 2013
INVENTOR(S) : Jeffrey David Stewart It is certified that error appears in the above-identified patent and that said Letters Patent is hereby corrected as shown below:

In the specification

In column 1, line 37, delete “chrondromalacia” and insert -- chondromalacia --, therefor.

In column 4, line 57, delete “second” and insert -- second. --, therefor.

Signed and Sealed this
Ninth Day of February, 2016

Michelle K. Lee

Michelle K. Lee
*Director of the United States Patent and Trademark Office*